US006799011B2

(12) United States Patent
Abe et al.

(10) Patent No.: US 6,799,011 B2
(45) Date of Patent: Sep. 28, 2004

(54) TANDEM-TYPE COLOR IMAGE FORMING APPARATUS

(75) Inventors: Nobumasa Abe, Nagano-ken (JP); Tomoe Aruga, Nagano-ken (JP); Yujiro Nomura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/283,345

(22) Filed: Oct. 30, 2002

(65) Prior Publication Data

US 2003/0086732 A1 May 8, 2003

(30) Foreign Application Priority Data

Nov. 5, 2001 (JP) ..... 2001-339164
Nov. 19, 2001 (JP) ..... 2001-352993
Nov. 19, 2001 (JP) ..... 2001-352995
Nov. 28, 2001 (JP) ..... 2001-362004

(51) Int. Cl.[7] ..... G03G 15/01; G03G 13/04; B41J 2/385

(52) U.S. Cl. ..... 399/299; 399/124; 399/302; 399/303; 347/138

(58) Field of Search ..... 399/299, 302, 399/110, 112, 121, 124, 92, 125, 303; 347/138, 152, 118, 119, 153

(56) References Cited

U.S. PATENT DOCUMENTS 4,987,455 A 1/1991 Lubberts
5,499,093 A 3/1996 Aerens et al.
5,532,812 A * 7/1996 Choi et al. ..... 347/119
5,974,289 A * 10/1999 Yamaguchi ..... 399/124
6,453,135 B1 * 9/2002 Sameshima et al. ..... 399/110
6,484,003 B2 * 11/2002 Tokutake et al. ..... 399/110
6,571,078 B2 * 5/2003 Munemori et al. ..... 399/302
6,580,443 B2 * 6/2003 Yamaguchi et al. ..... 347/118

FOREIGN PATENT DOCUMENTS

JP 8-305115 A 11/1996
JP 11-095520 A 4/1999

OTHER PUBLICATIONS

Japanese Patent Abstract No. 08087151 dated Apr. 2, 1996.

* cited by examiner

*Primary Examiner*—Sandra Brase
(74) *Attorney, Agent, or Firm*—Sughrue Mion, PLLC

(57) ABSTRACT

To prevent a belt and image forming means from being stained by spilled toner and also reduce the vibration of an exposure means. An image forming apparatus is of a tandem type in which mage forming stations Y, M, C, K for respective colors are arranged along a transfer belt 14. Each image forming station Y, M, C, K has an image carrier 17, a charging means 19 and a developing means 20 which are arranged around the image carrier 17. The image forming apparatus forms a multi-color image by passing the transfer belt 14 through the respective image forming stations. The transfer belt 14 is laid around a driving roller 12 and a driven roller 13 with a constant tension. One of the driving roller and the driven roller is positioned obliquely above the other roller, the driving roller and the driven roller are disposed such that the belt tension side at the time of driving the transfer belt is on the lower side, and the image carriers of the respective image forming stations are in contact with the belt tension side.

39 Claims, 16 Drawing Sheets

TANDEM-TYPE COLOR IMAGE FORMING APPARATUS

BACKGROUND OF THE INVENTION

The present invention relates to a tandem-type image forming apparatus in which image forming stations for respective colors are arranged along a transfer belt, each image forming station being composed of an image carrier, a charging means and a developing means which are arranged around the image carrier. The image forming apparatus forms a multi-color image by passing the transfer belt through every station.

Tandem-type image forming apparatuses as described above are categorized into two types as:

(1) an apparatus employing a paper delivery method which comprises a plurality of image forming stations arranged in an array, in which a receiving medium is electrostatically attracted to a delivery belt and is carried to be brought in contact with the respective stations in order and electrostatic transferring force is applied between each station and the recording medium, thereby superposing toner images of plural colors while directly transferring the toner images to the receiving medium; and (2) an apparatus employing an intermediate transfer method which comprises a plurality of image forming stations arranged in an array, in which an intermediate transfer belt made of a dielectric substance is carried to be brought in contact with the respective stations and electrostatic transferring force is applied between each station and the intermediate transfer belt so as to transfer primarily toner images of the respective stations one by one to superpose the toner images on the intermediate transfer belt and the superposed toner images are transferred secondarily from the intermediate transfer belt to a recording medium at once.

In the aforementioned paper delivery method, it is required to provide a means (roller or brush) for attracting the receiving medium to the delivery belt and high voltage power supply. In the intermediate transfer method, however, such a means and high voltage power supply are not required. Further, in the paper delivery method, it is required to strictly control the transfer bias to be applied to respective image transferred portion according to the size, the thickness, and the kind of the receiving medium. In the intermediate transfer method, the primary transfer of toner images is conducted to the intermediate transfer belt of which resistance, thickness, and surface roughness are constant regardless of the aforementioned factors of the receiving medium. The control of the transfer condition including the transfer voltage or transfer current and contact pressure must be conducted only for the secondary transfer of the toner images to the receiving medium. Therefore, the intermediate transfer method has a lot of advantages.

On the other hand, the apparatus can also be categorized according to the arrangement of the respective image forming stations. There are a method of arranging the stations horizontally and a method of arranging the stations vertically. The former has a disadvantage of requiring a larger area for placing, while the latter has a disadvantage of making the apparatus too tall to be put on a desk.

Therefore, a method of arranging the respective image forming stations obliquely is conventionally known as disclosed in Japanese Patent Unexamined Publication No. H11-95520 and Japanese Patent Unexamined Publication No. H8-305115.

However, this method has a disadvantage as follows. Since the image forming stations are arranged at an upper portion of a belt, which may be either the receiving medium delivery belt or the intermediate transfer belt, obliquely disposed, toner may spill from developing means of each image forming station so as to stain image forming means such as the belt, thereby deteriorating the image quality. In addition, an exposure means must be located at an upper portion of the apparatus, thereby increasing the vibration of the apparatus and thus also deteriorating the image quality.

The first object of the present invention is to provide an image forming apparatus, capable of resolving the aforementioned conventional problems, which comprises respective image forming stations arranged obliquely and can prevent image forming means such as a belt from being stained by spilled toner and also reducing the vibration of an exposure means.

Whether the image forming stations are arranged vertically or obliquely, the important matter is the position of a fixing device in order to make the apparatus compact. This is because the image quality is deteriorated when the heat and/or vibration generated from the fixing device is transmitted to the exposure means, the transfer belt, and the image forming means. It is also important to allow easy maintenance of the fixing device and easy removal of a jammed paper sheet around the fixing device. It is still also important to allow easy removal of a jammed paper sheet around the transfer belt and easy replacement of consumables such as the image carriers and the developing means. For this, Japanese Patent Unexamined Publication No. 2001-142378 discloses an apparatus in which a transfer belt is pivotally moved outside of the apparatus to allow replacement of consumables. However, this apparatus has a problem that it is impossible to replace the developing means alone, a problem of toner scattering, and a problem that it is difficult to maintain the fixing device itself and difficult to remove a jammed paper sheet around the transfer belt or around the fixing device.

Therefore, the second object of the present invention is to provide an image forming apparatus, capable of resolving the aforementioned conventional problems, which comprises respective image forming stations arranged obliquely or vertically, allows easy replacement of consumables, facilitates the maintenance of a developing means and a fixing device itself, and facilitates the removal of jammed paper sheets from near a transfer belt or around the fixing device.

SUMMARY OF THE INVENTION

For achieving the aforementioned first object, the present invention provides an image forming apparatus of a tandem type comprising image forming stations for respective colors arranged along a transfer belt, each image forming station including an image carrier, a charging means and a developing means disposed around said image carrier, wherein the transfer belt is passed through the respective image forming stations, thereby forming a multi-color image, and said image forming apparatus being characterized in that said transfer belt is laid around the driving roller and the driven roller with a constant tension, one of the driving roller and the driven roller is positioned obliquely above the other roller, the driving roller and the driven roller are disposed such that the belt tension side at the time of driving the transfer belt is on the lower side, and the image carriers of the respective image forming stations are in contact with the belt tension side.

According to this arrangement, the transfer belt and the exposure means are prevented from being stained by spilled toner and the vibration of the exposure means is reduced. In addition, the fixing means can be arranged in a space formed obliquely above the components in the apparatus, thereby enabling the reduction in heat transfer to the exposure means, the transfer belt, and the image forming means and lessening the frequency of taking the action for correcting color registration error.

For achieving the aforementioned second object, the present invention provides an image forming apparatus comprising image forming stations for respective colors arranged along a transfer belt, each image forming station including an image carrier, a charging means and a developing means disposed around said image carrier, wherein the transfer belt and the respective image forming stations are arranged obliquely or vertically, said image forming apparatus being characterized by further comprising: a housing body in which said respective image forming stations and the transfer belt are arranged; and a first movable section and a second movable section which are attached to said housing body such that the first and second movable sections are pivotally movable relative to said housing body, wherein a paper handling means and a fixing means are located in said first movable section and at least one of developing means, image carriers, and the transfer belt is located in said second movable section.

According to the aforementioned arrangement, in the image forming apparatus in which the respective image forming stations are arranged obliquely or vertically, the easy replacement of consumables is allowed, and the easy maintenance of the fixing device and the easy removal of jammed paper around the transfer belt and about the fixing device are also allowed.

DETAILED DESCRIPTION OF THE PREFERRED EMBODIMENTS

Figure 1:
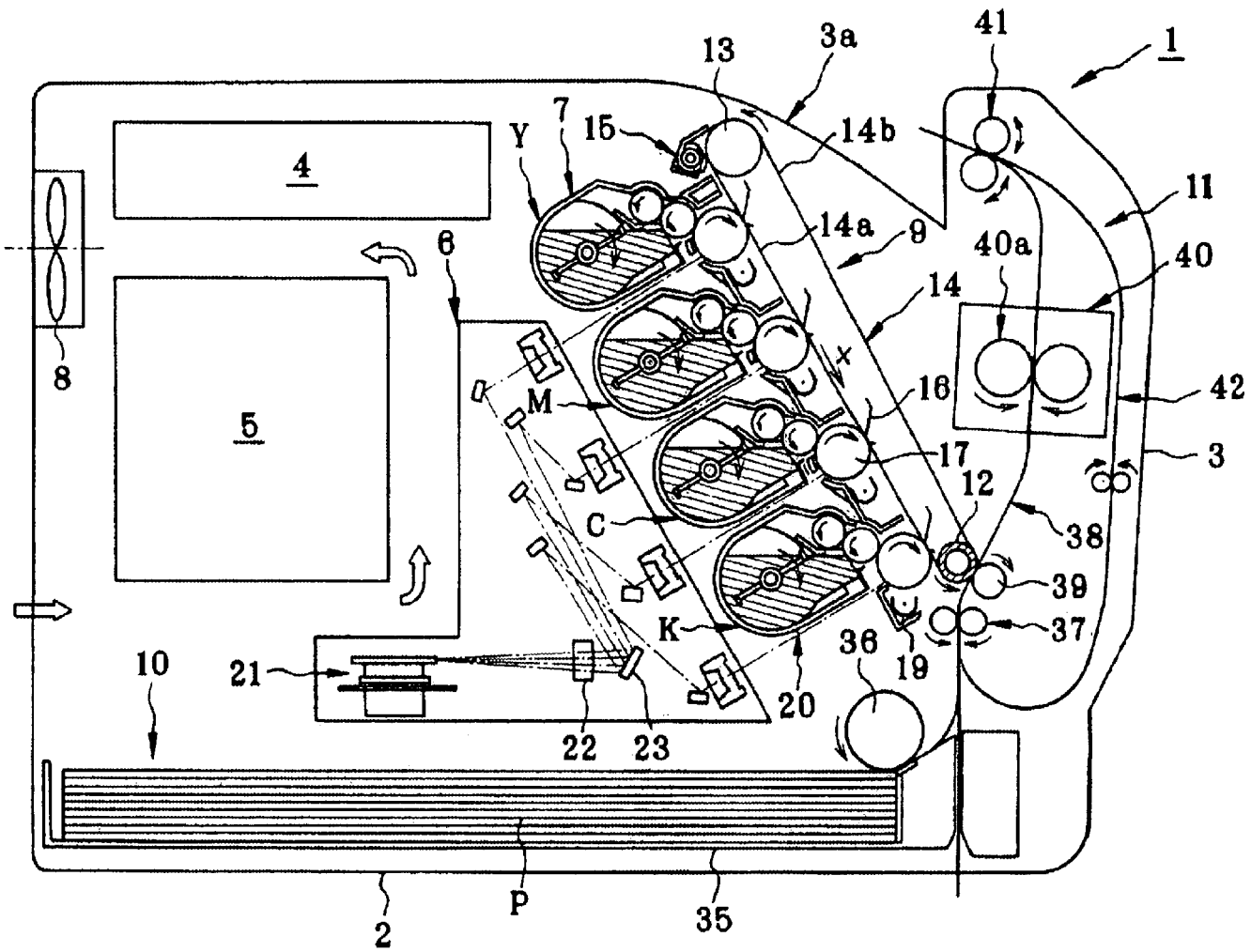
FIG. 1 is schematic sectional view showing the entire structure of an embodiment of an image forming apparatus of the present invention.
Figure 2:
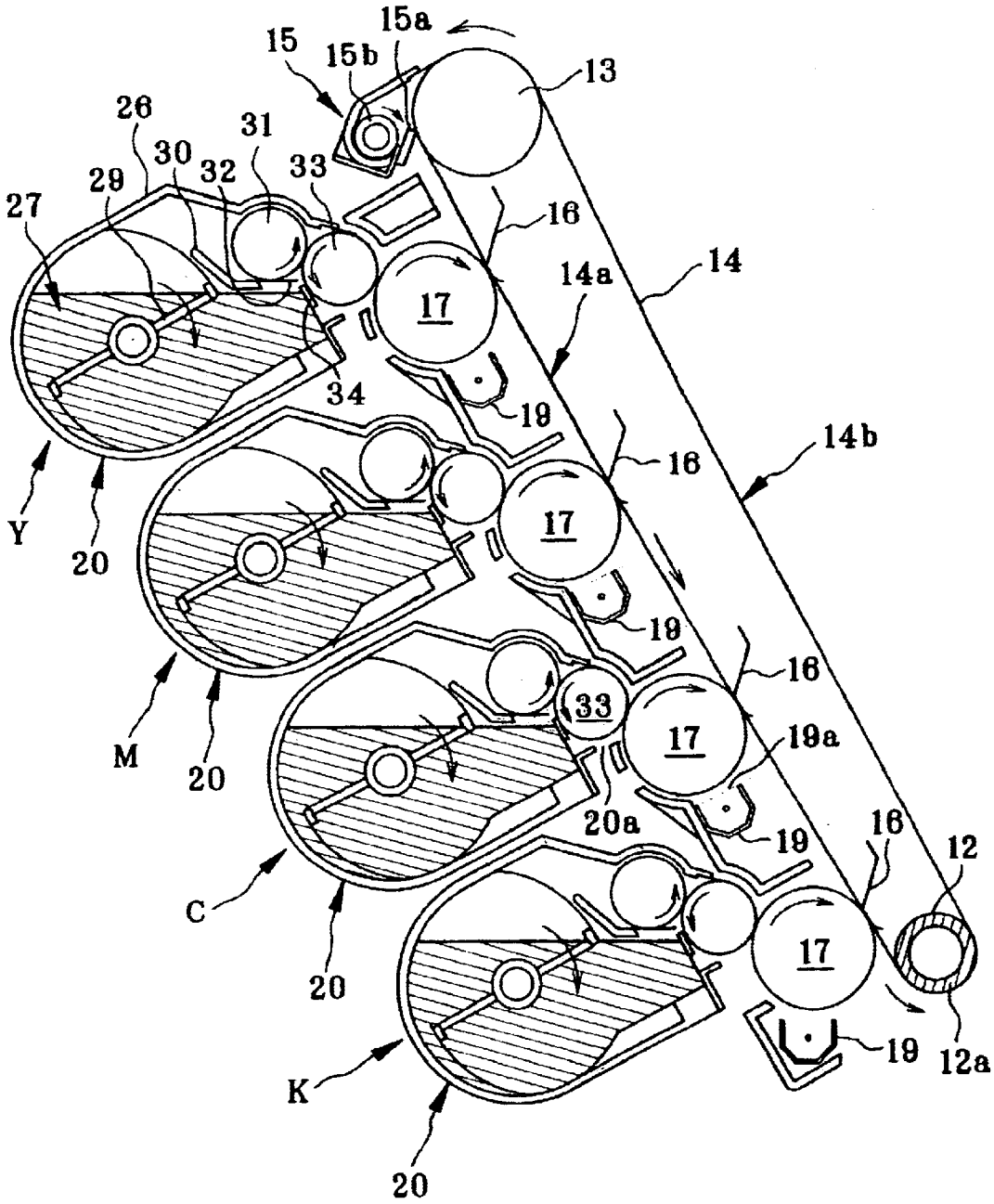
FIG. 2 is an enlarged view of a transfer belt and an image forming unit of the apparatus of FIG. 1.

Hereinafter, embodiments of the present invention will be described with reference to the drawings. FIG. 1 and FIG. 2 show an embodiment of the image forming apparatus of present invention, wherein FIG. 1 is a schematic sectional view showing the entire structure thereof and FIG. 2 is an enlarged view of main parts in FIG. 1. This embodiment is of a type employing the intermediate transfer method as described above.

In FIG. 1, the image forming apparatus 1 of this embodiment comprises a housing body 2, a first movable section (door body) 3 which is attached to the front of the housing body 2 in such a manner that the first movable section is able to open or close freely, and an outfeed tray (outfeed portion) 3*a* formed in the top of the first movable section 3. Arranged within the housing body 2 are a control unit 4, a power source unit 5, an exposure unit (exposure means) 6, an image forming unit 7, a cooling means 8 composed of an air fan, a transfer belt unit 9, and a paper feeding unit 10. Arranged within the first movable section 3 is a paper handling means 11. The image forming unit 7 and the paper feeding unit 10 are designed to be detachable relative to the housing body 2. In this case, the components including the transfer belt unit 9 can be detached for the purpose of repair or replacement of consumables.

The transfer belt unit 9 comprises a driving roller 12 which is disposed in a lower portion of the housing body 2 and is driven by a driving means (not shown) to rotate, a driven roller 13 which is disposed diagonally above the driving roller 12, an intermediate transfer belt 14 which is laid around the two rollers with a constant tension and is driven to circulate in a direction indicated by an arrow (the counter-clockwise direction), and a cleaning means 15 which abuts on the surface of the intermediate transfer belt 14. The driven roller 13 and the intermediate transfer belt 14 are arranged obliquely to the upper left of the driving roller 12. Accordingly, during the operation of the intermediate transfer belt 14, a belt face 14*a* of which traveling direction X is downward takes a lower side and a belt face 14*b* of which traveling direction is upward takes an upper side. In this embodiment, the belt face 14*a* is a tension side (side tensioned by the driving roller 12) at the time of driving the intermediate transfer belt 14 and the belt face 14*b* is a slack side at the time of driving the intermediate transfer belt 14.

The driving roller 12 also functions as a back-up roller for a secondary transfer roller 39 described later. As shown in FIG. 2, formed on the peripheral surface of the driving roller 12 is a rubber layer 12*a* which is 3 mm in thickness and $10^5$ Ω·cm or less in volume resistivity. The driving roller 12 has a metallic shaft which is grounded so as to function as a conductive path for secondary transfer bias supplied through the secondary transfer roller 39. Since the driving roller 12 is provided with the rubber layer 12*a* having high friction and shock absorption, impact generated when a receiving medium is fed into a secondary transfer section is hardly transmitted to the intermediate transfer belt 14, thereby preventing the deterioration of image quality.

In this embodiment, the diameter of the driving roller 12 is set to be smaller than the diameter of the driven roller 13. This facilitates the separation of a receiving medium after secondary transfer because of the elastic force of the receiving medium itself. The driven roller 13 also functions as a back-up roller for the cleaning means 15 described later.

The cleaning means 15 is located at the belt face 14*a* side, of which traveling direction is downward. As shown in FIG. 2, the cleaning means 15 comprises a cleaning blade 15*a* for removing toner remaining on the surface of the intermediate transfer belt 14 after the secondary transfer, and a toner carrying member 15*b* for carrying collected toner. The cleaning blade 15*a* is in contact with the intermediate transfer belt 14 at a position where is wrapped around the driven roller 13.

On the back of the intermediate transfer belt 14, primary transfer members 16 composed of leaf spring electrodes are disposed. The primary transfer members 16 are pressed into contact with the back of the intermediate transfer belt 14 by their elastic force at locations corresponding to image carriers 17 of respective image forming stations Y, M, C, and K, described later. A transfer bias is applied to each primary transfer member 16.

The image forming unit 7 comprises the image forming stations Y (for yellow), M (for magenta), C (for cyan), and K (for black) for forming multi-color images (in this embodiment, four-color images). As clearly shown in FIG. 2, each image forming station Y, M, C, K has an image carrier 17 composed of a photosensitive drum, a charging means 19 composed of a corona charging means, and developing means 20 which are arranged around the image carrier 17. It should be understood that the image forming stations Y, M, C, K may be arranged in any order.

The image forming stations Y, M, C, K are disposed such that the respective image carriers 17 are in contact with the belt face 14*a*, of which traveling direction is downward, of the intermediate transfer belt 14. As a result of this, the image forming stations Y, M, C, K are arranged in an obliquely leftward direction relative to the driving roller 12 in FIG. 2. Each image carrier 17 is driven to rotate in the traveling direction of the intermediate transfer belt 14 as indicated by arrows. It should be noted that the intermediate transfer belt 14 may be arranged in an obliquely rightward direction relative to the driving roller 12. In this case, the belt traveling direction X should be the counter direction and the belt face of which traveling direction is downward should be the surface 14*b*.

Now, the charging means 19 will be described in detail, taking the image forming station C in FIG. 2 as an example. The developing means 20 has a development roller aperture 20*a* disposed adjacent to a development roller 33. The corona charging means 19 as the charging means has an upward opening 19*a* which opens upwardly to the image carrier 17. If the upward opening 19*a* of the corona charging means 19 is positioned below the development roller aperture 20*a*, toner spills from the development roller aperture 20*a* because of the gravity and thus enters into the corona charging means 19 through the upward opening 19*a* so as to undesirably stain the corona charging means 19.

In this embodiment, the upward opening 19*a* of the corona charging means 19 is offset toward the intermediate transfer belt 14 from the development roller aperture 20*a* of the developing means 20 such that the upward opening 19*a* does not overlap relative to the development roller aperture 20*a*. This can solve the possible problem that toner spills from the development roller aperture 20*a* because of the gravity and thus enters into the corona charging means 19 through the upward opening 19*a* so as to undesirably stain the corona charging means 19.

The exposure means 6 is disposed in a space formed obliquely below the image forming unit 7 which is arranged obliquely. The control unit 4 and the power source unit 5 are disposed in a space above the exposure means 6. The paper feeding unit 10 is disposed below the exposure means 6 and at the bottom of the housing body 2. Since the control unit 4 and the power source unit 5 are arranged adjacent to the exposure means 6, this arrangement can reduce the area for placing as compared to a case in which these are arranged in parallel to the frame supporting components of the apparatus.

Figure 3:
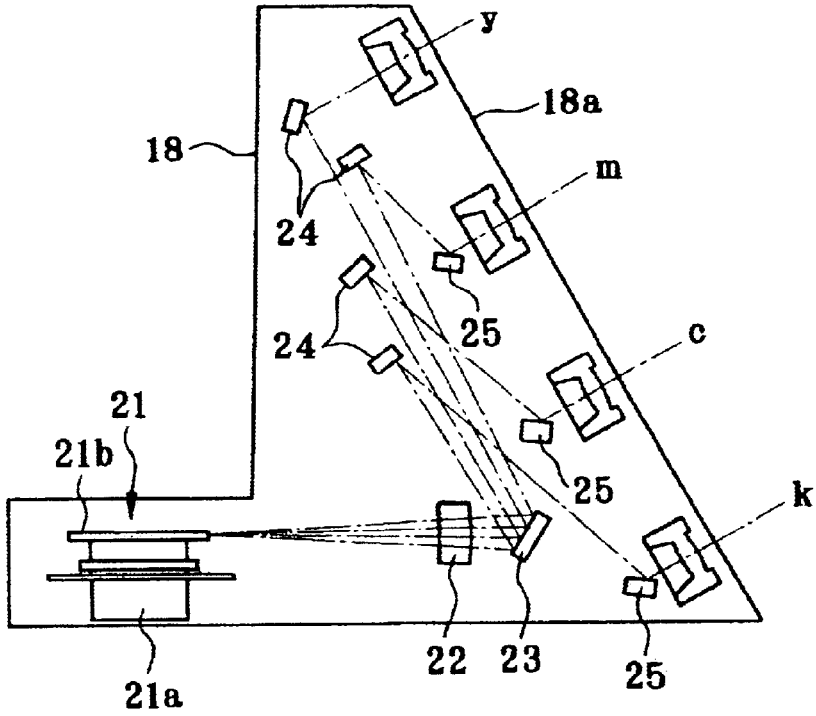
FIG. 3 is an enlarged view of an exposure means of the apparatus of FIG. 1.

As shown in FIG. 1 and FIG. 3, the exposure means 6 has a casing 18 which is arranged in a space formed obliquely below the belt face 14*a* of which traveling direction is downward such that an inclined plane 18*a* of the casing 18 is parallel to the belt face 14*a*. At the bottom of the casing 18, a single scanner means 21, composed of a polygon mirror motor 21*a* and a polygon mirror 21*b*, is disposed and, in addition, a single f-θ lens 22 and a reflection mirror 23 are disposed. In addition, four reflective mirrors 24 are disposed above the reflection mirror 23 to make scanning lines y, m, c, k parallel to the inclined plane 18*a* (the belt face 14*a*) and three reflective mirrors 25 are further disposed to aim the scanning lines m, c, k, reflected by the reflective mirrors 24, to the image carriers 17.

By providing the reflective mirrors 24, 25, the scanning lines y, m, c, k are bent, thereby shortening the height of the casing 18 and thus making the apparatus compact. The reflective mirrors 24, 25 are arranged in such a manner as to make the respective lengths of the scanning lines to the image carriers 17 of the image forming stations Y, M, C, K equal to each other.

In the exposure means 6 having the aforementioned structure, image signals corresponding to the respective colors are formed and modulated according to the common data clock frequency and are then radiated from the polygon mirror 21*b*. The radiated image signals are aimed to the image carriers 17 of the image forming stations Y, M, C, K via the f-θ lens 22, the reflection mirror 23, and the reflective mirrors 24, 25, thereby forming latent images.

In this embodiment, the scanning optical system is arranged at a lower side of the apparatus, thereby minimizing the vibration of the scanning optical system due to vibration of the driving system of the image forming means which affects the frame supporting the apparatus and thus preventing the deterioration of image quality. In particular, by arranging the scanning means 21 at the bottom of the casing 18, vibration of the polygon motor 21*a* affecting the casing 18 can be minimized, thereby preventing the deterioration of image quality. Since only a single polygon motor 21*a* is provided which is a vibration source, vibration affecting the casing can be minimized.

The cooling means 8 composed of an air fan is provided on one side of the housing body 2 to introduce atmosphere in a direction of arrows in order to cool the exposure means 6, the control unit 4, and the power source unit 5. Atmosphere drawn inside the apparatus from the rear side in the feeding direction of paper sheets P or in the width direction of the feeding direction of paper sheets P is introduced to the periphery of the polygon motor 21*a*, is then introduced to the control unit 4 and the power source unit 5, and, after that, is discharged outside of the apparatus, thereby restricting the increase in temperature of the polygon motor 21*a*, preventing the deterioration of image quality and increasing the life of the polygon motor 21*a*.

Hereinafter, the developing means 20 will be described in detail, taking the image forming station Y in FIG. 2 as an example. In this embodiment, since the image forming stations Y, M, C, K are arranged obliquely and the image carriers 17 are in contact with the belt face 14*a*, of which traveling direction is downward, of the intermediate transfer belt 14, toner containers 26 are arranged obliquely downward. For this, special structure is employed in the developing means 20.

That is, the developing means 20 each comprises the toner container 26, a toner storage area 27 formed in the toner container 26 for storing toner (indicated by hatching), a toner agitating member 29 disposed inside the toner storage area 27, a partition 30 defined in an upper portion of the toner storage area 27, a toner supply roller 31 disposed above the partition 30, a flexible blade 32 attached to the partition 30 to abut the toner supply roller 31, the development roller 33 arranged to abut both the toner supply roller 31 and the image carrier 17, and a regulating blade 34 arranged to abut the development roller 33.

The image carrier 17 is rotated in the traveling direction of the intermediate transfer belt 14. The development roller 33 and the supply roller 31 are rotated in a direction opposite to the rotational direction of the image carrier 17 as shown by arrow. On the other hand, the agitating member 29 is rotated in a direction opposite to the rotation of the supply roller 31. Toner agitated and scooped up by the agitating member 29 in the toner storage area 27 is supplied to the toner supply roller 31 along the upper surface of the partition 30. Friction is caused between the toner and the flexible blade 32 so that mechanical adhesive force and adhesive force by triboelectric charging are created relative to the rough surface of the supply roller 31. By these adhesive forces, the toner is supplied to the surface of the development roller 33. The toner supplied to the development roller 33 is regulated into a coating layer having a predetermined thickness by the regulating blade 34. The toner layer as a thin layer is carried to the image carrier 17 so as to develop a latent image on the image carrier at and near a nip portion which is a contact portion between the development roller 33 and the image carrier 17.

In this embodiment, the development roller 33 disposed facing the image carrier 17, the toner supply roller 31, and the contact portion of the regulating blade 34 relative to the development roller 33 are not submerged in the toner. This arrangement can prevent the contact pressure of the regulating blade 34 relative to the development roller 33 from being varied due to the decrease of the stored toner. In addition, since excess toner scraped from the development roller 33 by the regulating blade 34 spills onto the toner storage area 27, thereby preventing filming of the development roller 33.

The contact portion between the development roller 33 and the regulating blade 34 is positioned below the contact portion between the supply roller 31 and the development roller 33. There is a passage for returning excess toner, which was supplied to the development roller 33 by the supply roller 31 but not transmitted to the development roller 33, and excess toner, which was removed from the development roller 33 by the regulating operation of the regulating blade 34, to the toner storage area 27 at the lower portion of the developing means. The toner returned to the toner storage area 27 is agitated with toner in the toner storage area 27 by the agitating member 29, and is supplied to a toner inlet near the supply roller 31 again. Therefore, the excess toner is let down to the lower portion without clogging the friction portion between the supply roller 31 and the development roller 33 and the contact portion between the development roller 33 and the regulating blade 34 with the excess toner and is then agitated with toner in the toner storage area 27, whereby the toner in the developing means deteriorates slowly so that portentous changes in image quality just after the replacement of the developing means is prevented.

As shown in FIG. 1 again, the paper feeding unit 10 comprises a sheet cassette 35 in which a pile of receiving media P are held, and a pick-up roller for feeding the receiving media P from the sheet cassette 35 one by one.

The paper handling means 11 comprises a pair of resist rollers 37 for regulating the feeding of a receiving medium P to the secondary transfer portion at the right time, the secondary transfer roller 39 as a secondary transfer means abutting and pressed against the driving roller 12 and the intermediate transfer belt 14, a sheet feeding passage 38, the fixing means 40, a pair of outfeed rollers 41, and a dual-side printing passage 42.

The fixing means 40 comprises a pair of fixing rollers 40*a* at least one of which has a built-in heating element such as a halogen heater and which are freely rotatable, and a pressing means for pressing at least one of the rollers against the other roller to fix a secondary image secondarily transferred to the receiving medium P. The secondary image secondarily transferred to the receiving medium is fixed to the receiving medium at the nip portion formed between the fixing rollers 40*a* at a predetermined temperature. In this embodiment, the fixing means 40 can be arranged in a space formed obliquely above the belt face 14*b*, of which traveling direction is upward, of the transfer belt, that is, a space formed on the opposite side of the image forming stations relative to the transfer belt. This arrangement enables the reduction in heat transfer to the exposure means 6, the intermediate transfer belt 14, and the image forming means and lessens the frequency of taking the action for correcting color registration error. In particular, the exposure means 6 is positioned farthest from the fixing means 40, thereby minimizing the deformation of the scanning optical components due to heat and thus preventing the occurrence of color registration error.

Figure 4:
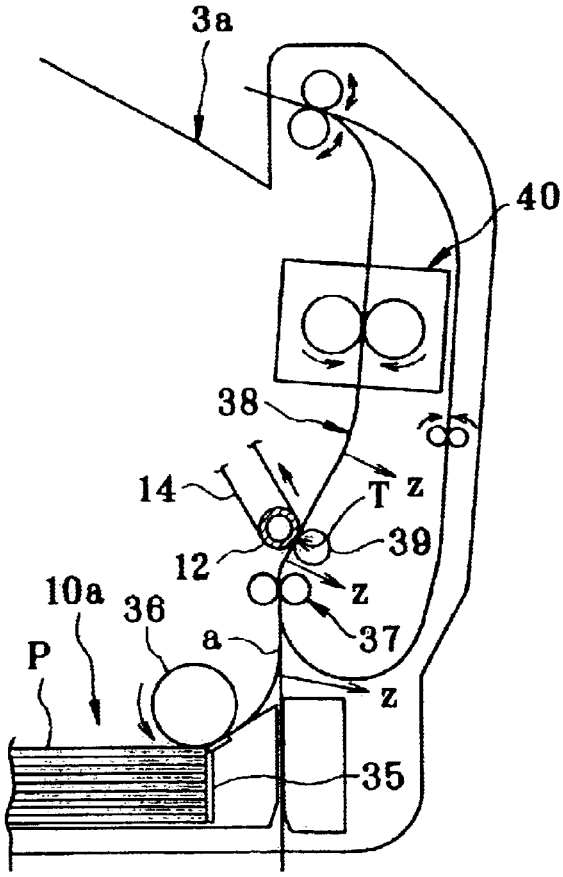
FIG. 4 is an enlarged view of a paper feeding means of the apparatus of FIG. 1.

The description will now be made as regard to the detail structure of the paper handling means 11 with reference to FIG. 4 through FIG. 6. In FIG. 4 and FIG. 6, there are a sheet feed portion 10*a* composed of the sheet cassette 35 and the pick-up roller 36 described with reference to FIG. 1, the resist rollers 37 arranged obliquely above the pick-up roller 36, the driving roller 12, the intermediate transfer belt 14, the secondary transfer roller 39 which is arranged obliquely above the resist rollers 37 and cooperates with the driving roller 12 to form a transfer portion T, the sheet feeding passage 38, the fixing means 40 arranged obliquely above the secondary transfer roller 39, the outfeed rollers 41, and the outfeed portion 3*a*.

The sheet feed portion 10*a* is disposed at a lower portion of the apparatus and the outfeed portion 3*a* is disposed at the top of the apparatus. The sheet feeding passage 38 comprises a feeding passage a between the sheet feed portion 10*a* and the resist rollers 37, a feeding passage b between the resist rollers 37 and the transfer portion T, a feeding passage c between the transfer portion T and the fixing means 40. These feeding passages a, b, c are designed to form a passage to be biased in zigzag manner as shown by arrows z in FIG. 4. According to this arrangement, a receiving sheet P is warped to the left at the feeding passage a and is warped to the right at the feeding passages b, c, thereby smoothly feeding receiving sheets P and thus preventing the jamming of paper, especially effectively preventing the jamming of thick paper sheets, OHP sheets, and the like.

Figure 5:
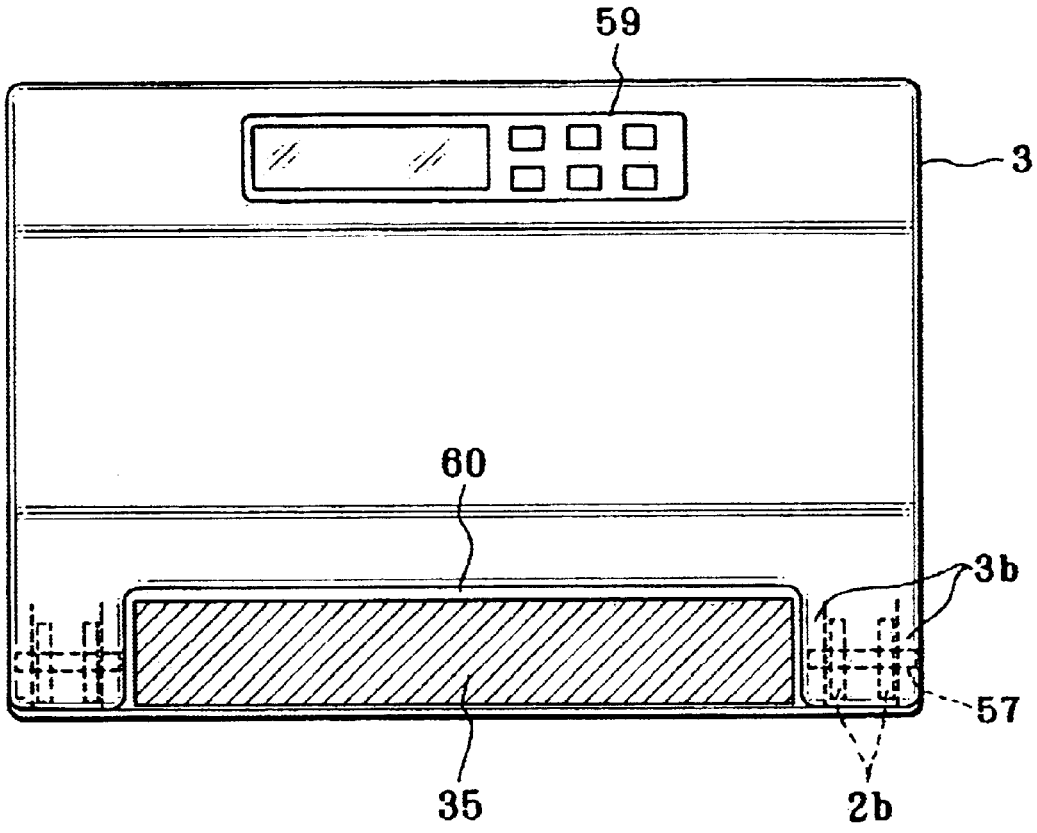
FIG. 5 is a front view as seen from the right side in FIG. 1.
Figure 6:
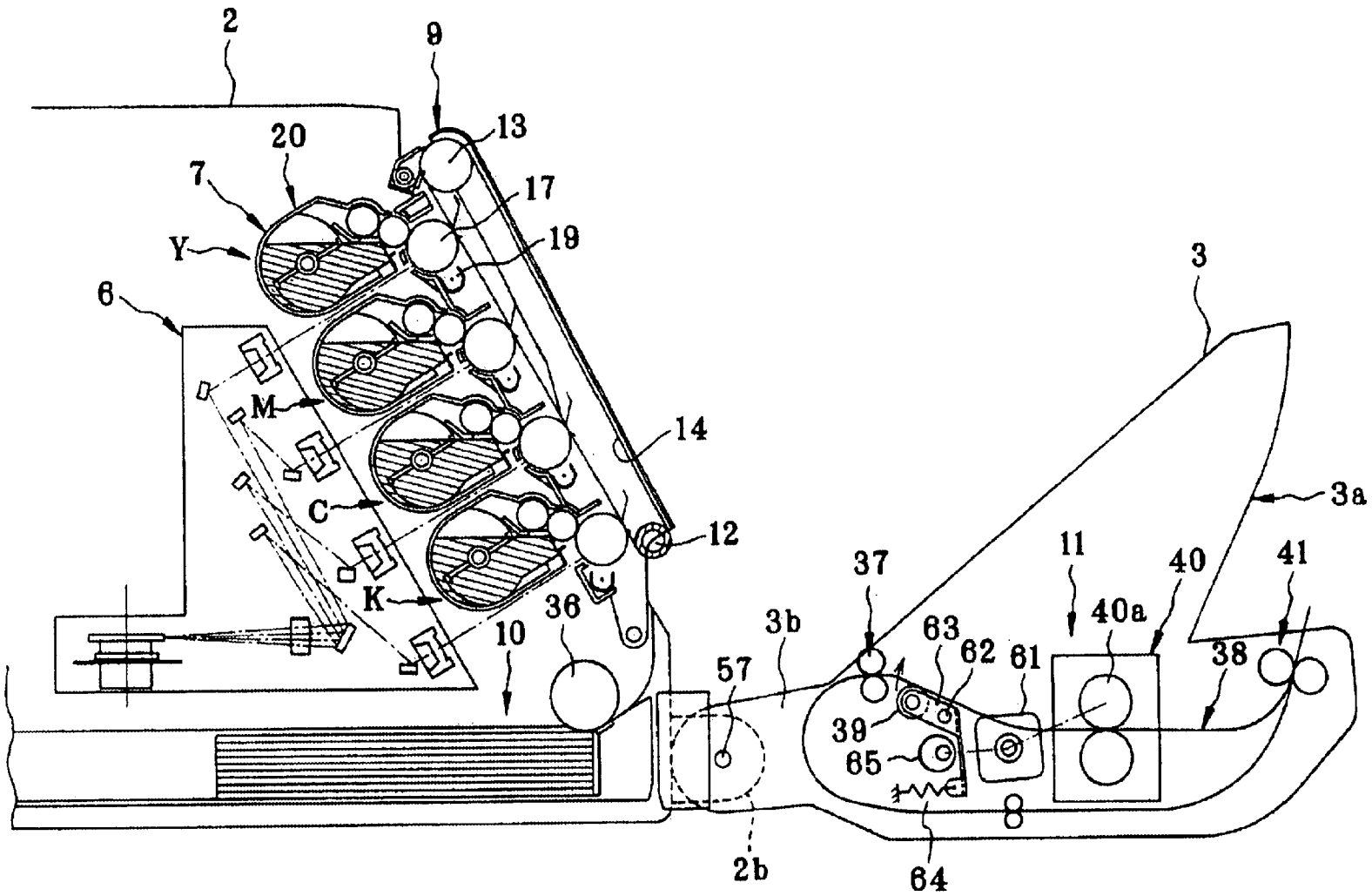
FIG. 6 is a schematic sectional view of the apparatus of FIG. 1 showing a state where a first movable section is opened.

As shown in FIG. 5 and FIG. 6, the housing body 2 has two pairs of stays 2*b* which are disposed on both sides of a lower front surface of the housing body 2, respectively, to project from the front surface. The first movable section 3 has pairs of pivotal portions 3*b* formed on both sides of a lower portion thereof. By inserting shafts 57 through the respective holes of the stays 2*b* and the pivotal portions 3*b*, the first movable section 3 is attached to the housing body 2 such that the first movable section 3 is pivotally movable relative to the housing body 2. The first movable section 3 is provided at an upper front surface thereof with a control panel 59. The housing body 2 is provided with an opening 60 for insertion of the sheet cassette 35 below the first movable section 3. In this embodiment, therefore, the respective units can be attached to and removed from the apparatus only by operation in front of the apparatus. This allows the apparatus to be placed in a narrow place.

FIG. 6 shows a state in which the first movable section 3 is opened from the housing body 2. In the first movable section 3, a driving motor 61 is arranged and a pivotal lever 63 is pivotally supported by a fixing shaft 62. One end of the pivotal lever 63 supports the shaft of the secondary transfer roller 39 and the other end is connected to the first movable section 3 through a spring 64. Normally, the secondary transfer roller 39 is biased in a direction of an arrow in FIG. 6 by means of the biasing force of the spring 64 so that the secondary transfer roller 39 can be pressed against the intermediate transfer belt 14 and the driving roller 12. An eccentric cam 65 is disposed on the spring 64 side of the pivotal lever 63. The pivotal lever 63, the spring 64, and the eccentric cam 65 cooperate to form a shifting means of moving the secondary transfer roller into contact with and apart from the intermediate transfer belt 14.

The rotational shaft of the driving motor 61 is connected to the shaft of one of the fixing rollers 40*a* via a transfer device (not shown) composed of a gear train and a clutch and is also connected to the cam shaft of the eccentric cam 65 via a transfer device (not shown) composed of a gear train and a clutch. According to this arrangement, the normal rotation of the driving motor 61 drives the fixing roller 40*a*, while the reverse rotation of the driving motor 61 rotates the eccentric cam 65. The rotation of the eccentric cam 65 biases the pivotal lever 63 to pivot against the biasing force of the spring 64 so as to move the secondary transfer roller 39 in a direction opposite to the direction of arrow so that the secondary transfer roller 39 is moved apart from the intermediate transfer belt 14.

According to this embodiment, the driving motor 61 is arranged in the first movable section 3 not in the housing body 2 so that the drive line between the fixing means 40 of which driving load is heavy and the driving motor 61 is not disconnected even when the first movable section 3 is opened, thereby preventing the occurrence of faults in sheet feeding and vibration of the apparatus as a whole due to faulty connection of the driving system and maintaining the image quality well. By reversely rotating the driving motor 61 when no receiving medium is transferred, the secondary transfer roller 39 can be spaced apart from the intermediate transfer belt 14. During this, correcting operation can be conducted, that is, images for testing density modulation or marks for detecting color registration error can be formed on the intermediate transfer belt 14 and read by a sensor. This arrangement avoids the necessity of providing a driving means exclusively for moving the secondary transfer roller 39 into contact with and apart from the intermediate transfer member.

Figure 7:
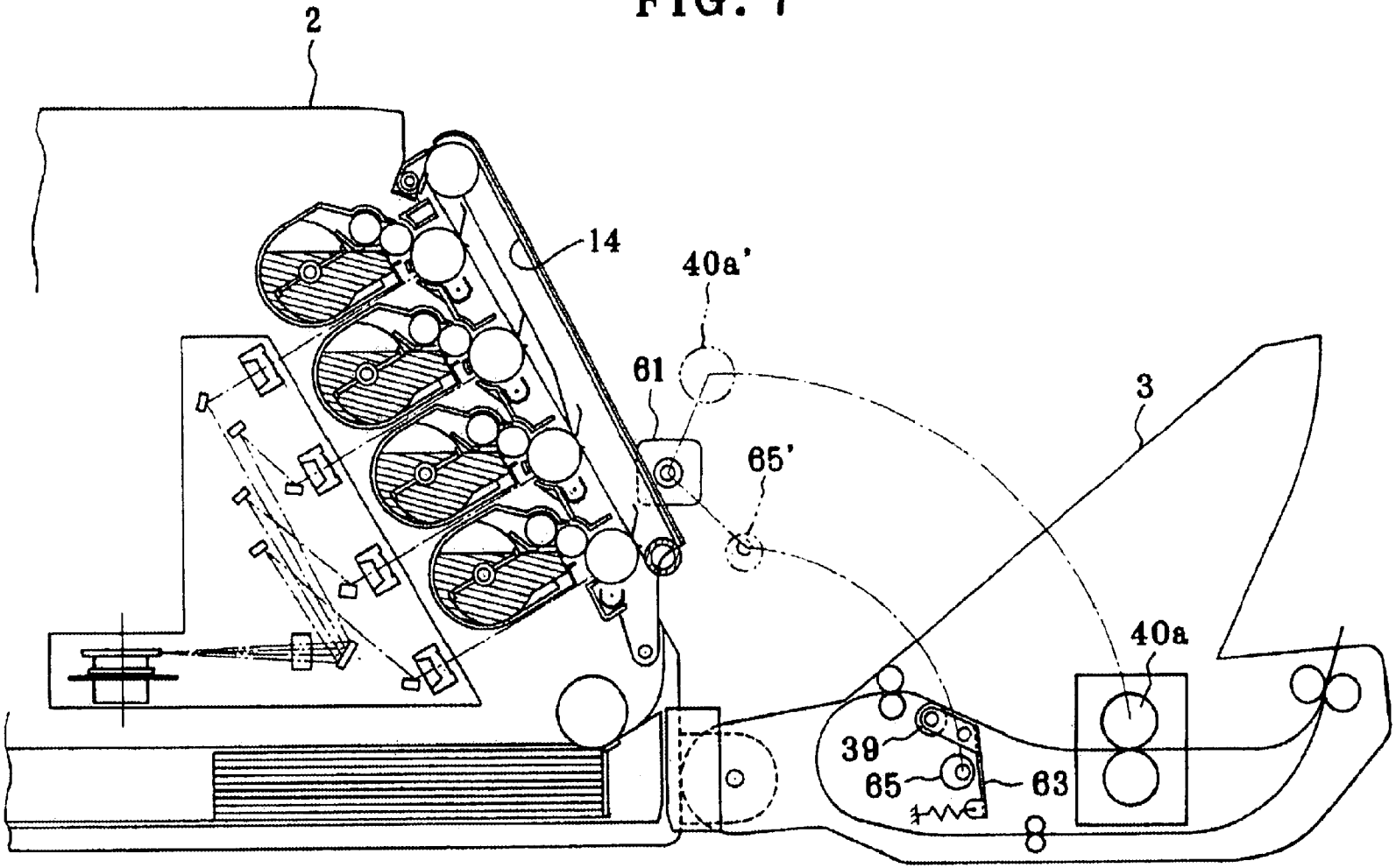
FIG. 7 is an illustration for explaining a variation of the embodiment of FIG. 6.

FIG. 7 shows a variation of the embodiment shown in FIG. 6. In this variation, the driving motor 61 is attached to the housing body 2 side and is arranged to be connected to the shaft of the fixing roller 40 and also to the cam shaft of the eccentric cam 65 when the first movable section 3 is closed to the housing body 2. Numerals 40*a*', 65' indicate positions of the secondary transfer roller 40*a* and the eccentric cam 65 when the first movable section 3 is closed. The other structure and works of this variation are the same as those of the embodiment of FIG. 6, so the description will be omitted.

Figure 8:
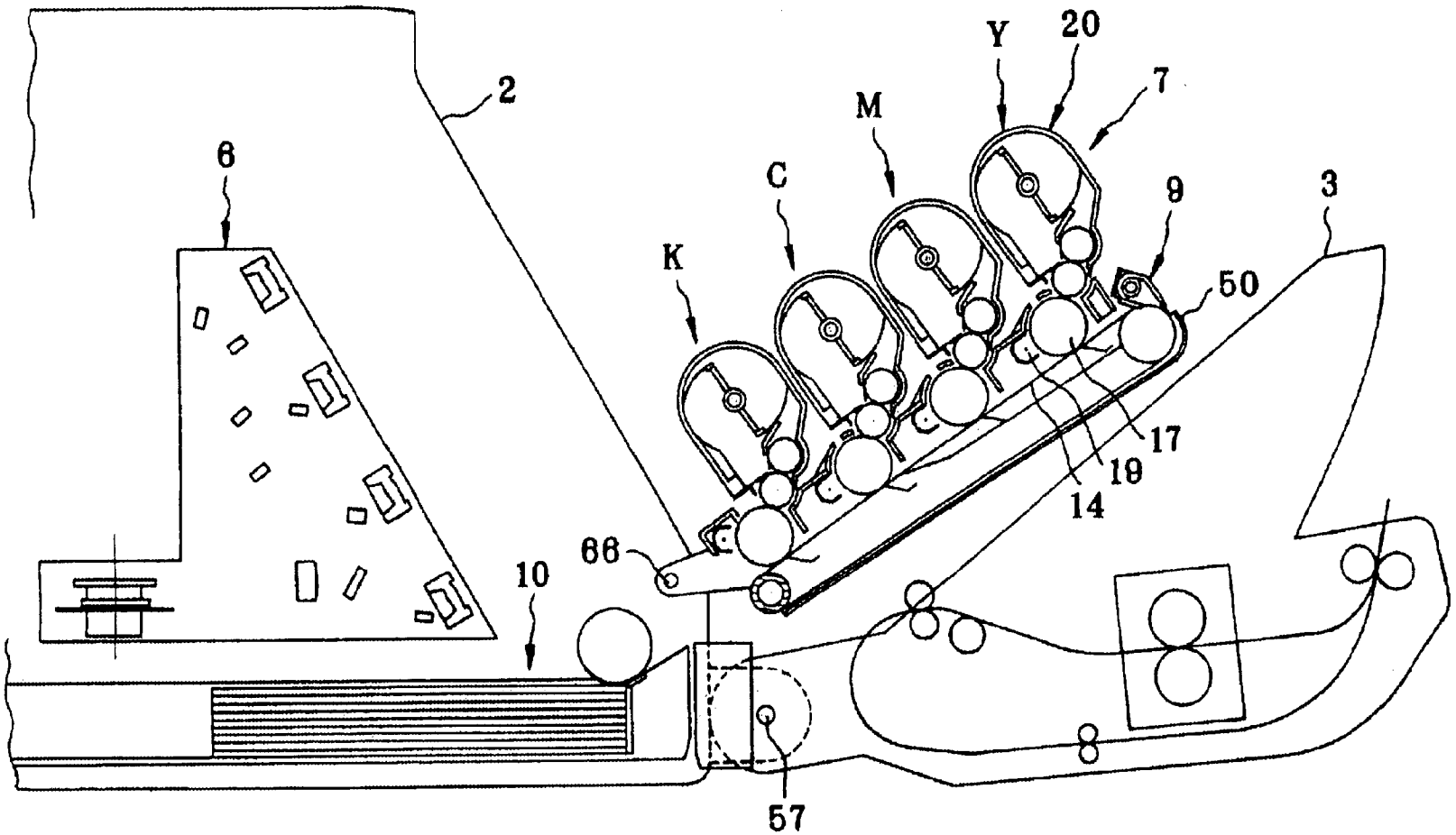
FIG. 8 is a schematic sectional view showing a state where a second movable section is opened from the state shown in FIG. 6.
Figure 9:
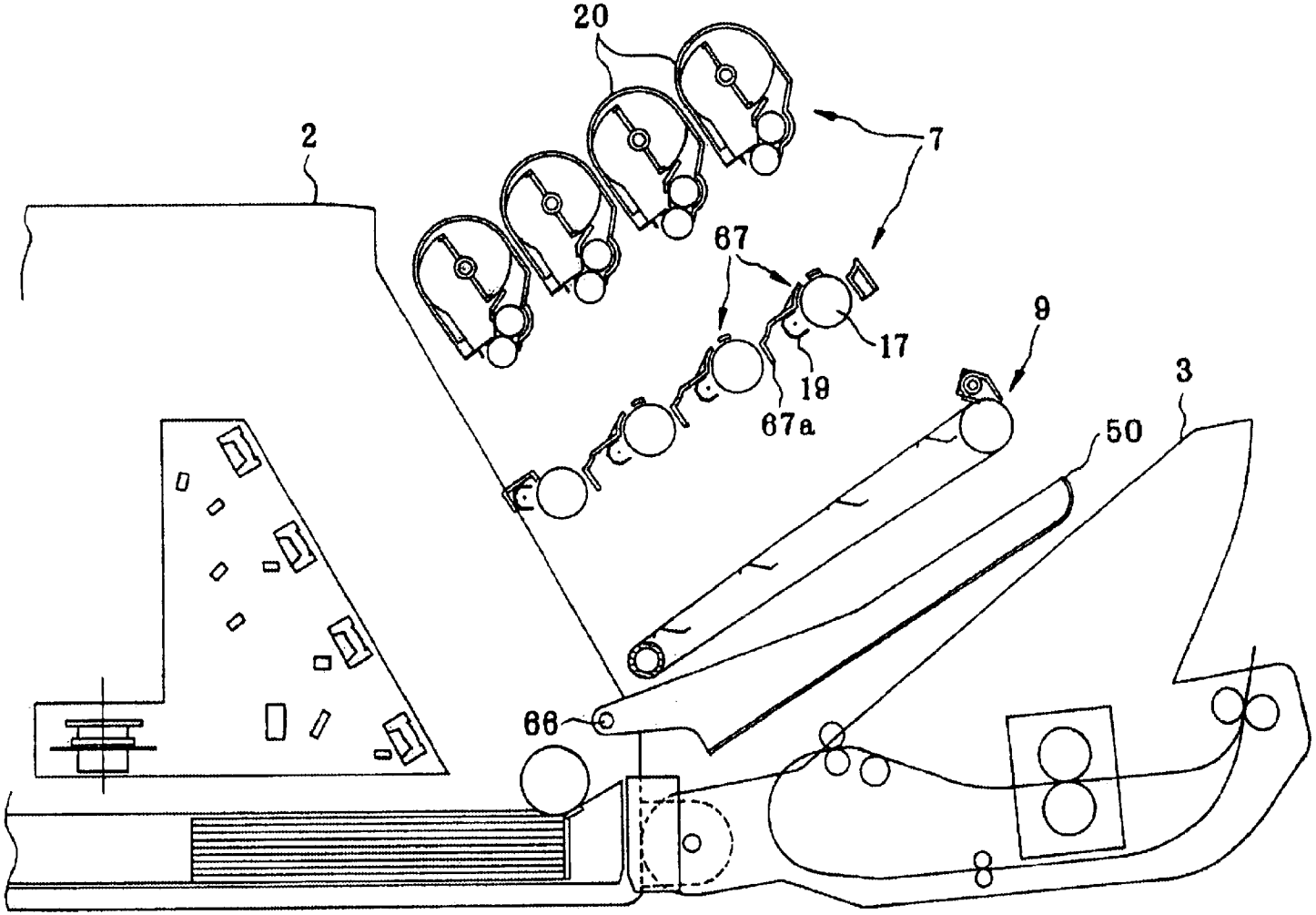
FIG. 9 is an illustration for explaining the replacement of consumables in the state shown in FIG. 8.

With reference to FIG. 8 and FIG. 9, replacement of consumables will be explained. In FIG. 8, the housing body 2 is provided with shafts 66 as pivots at a position above the shafts 57 of the first movable section 3. Pivotally supported by the shafts 66 are a second movable section 50 composed of frames. The transfer belt unit 9 and the image forming unit 7 described with reference to FIG. 1 are retained to the second movable section 50. In the state where the first movable section 3 is opened and the second movable section 50 is also opened to the front, the image forming unit 7 and the transfer belt unit 9 are exposed outside.

As shown in FIG. 9, the developing means 20 and image carrier units (each including a frame 67*a* supporting the image carrier 17 and the charging means 19) 67 for the respective colors, which cooperate to compose the image forming unit 7, and the transfer belt unit 9 can be removed from the second movable section 50 for the purpose of repair or replacement. In this embodiment, the positions of the developing means 20, the image carrier 17, and the transfer belt 14 are easily defined relative to each other, thereby facilitating the replacement operation.

Figure 10:
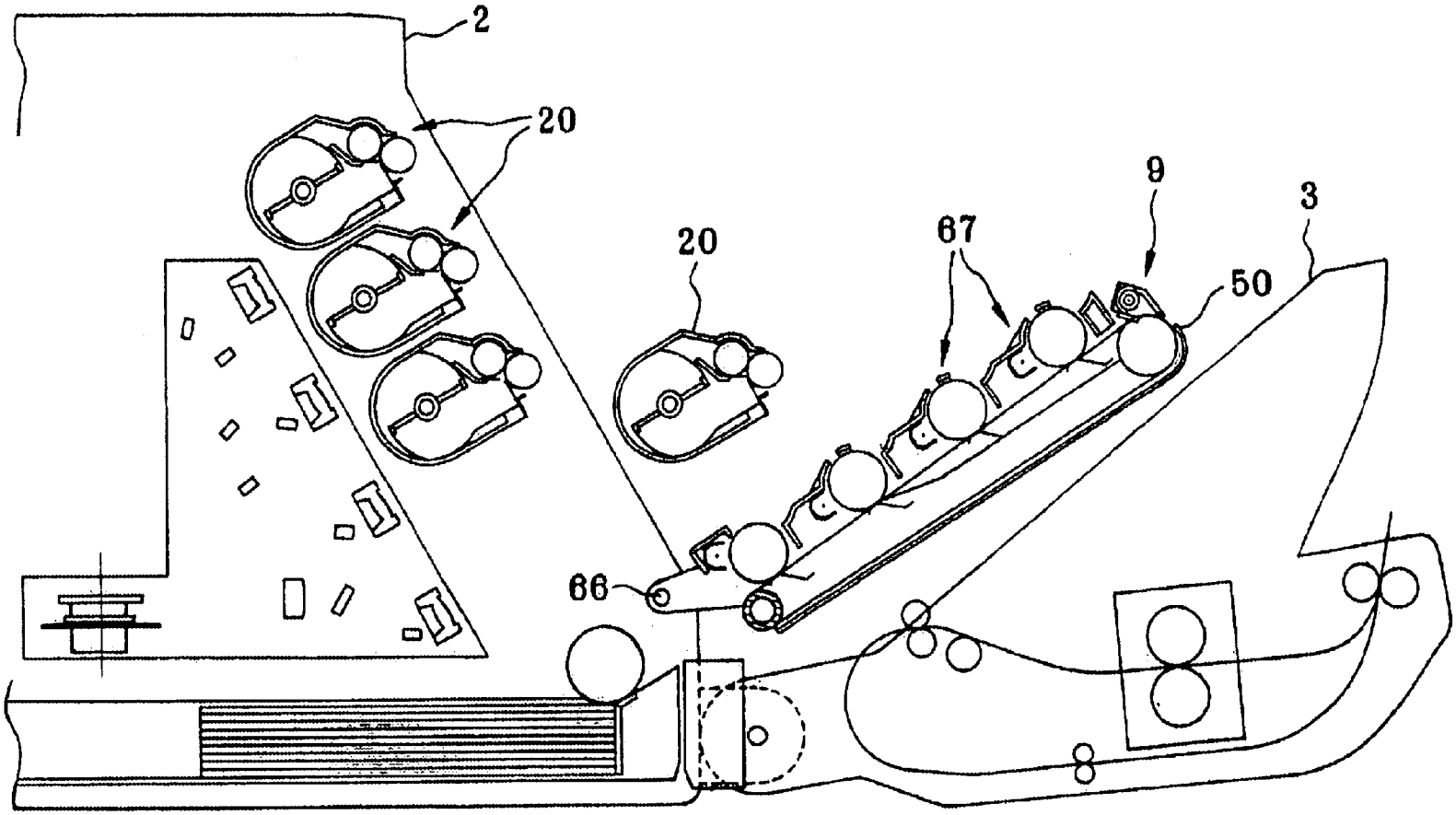
FIG. 10 is an illustration for explaining a variation of the embodiment of FIG. 8.
Figure 11:
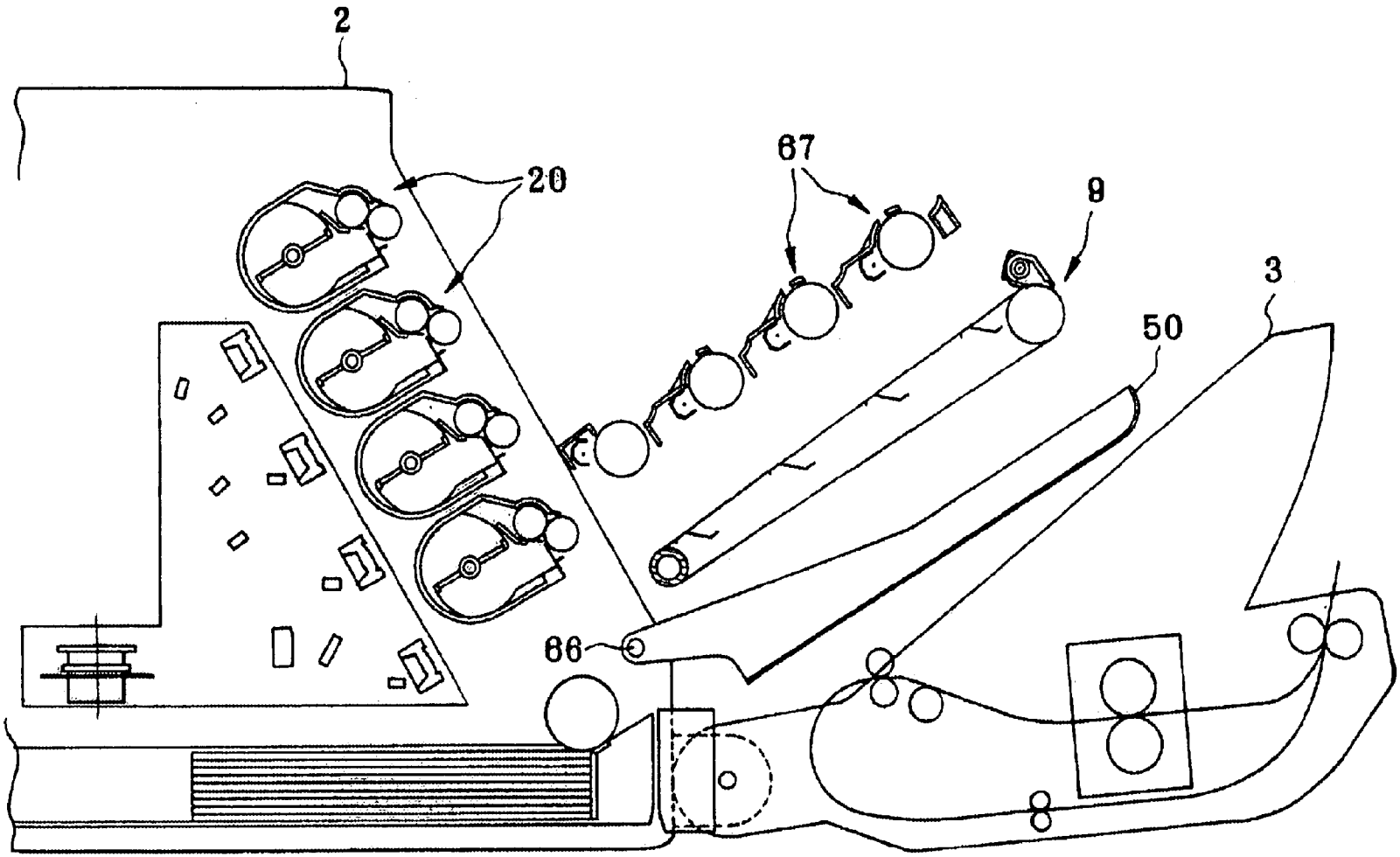
FIG. 11 is an illustration for explaining the replacement of consumables in the state shown in FIG. 10.

FIG. 10 and FIG. 11 show a variation of the embodiment shown in FIG. 8. In this variation, the transfer belt unit 9 and the image carrier unit 67 are retained to the second movable section 50 and the developing means 20 is retained to the housing body 2. Accordingly, the replacement of the image carrier unit 67 and the developing means 20 can be selectively and separately conducted. It should be noted that the image carrier units 67 may be retained by the housing body 2.

In this embodiment, the first movable section 3 as a cover of the apparatus, the resist rollers 37, the secondary transfer roller 39, the sheet feeding passage 38, and the fixing means 40 can be all released in front of the apparatus where is a space required for the operation of drawing and inserting the sheet cassette 35, thereby improving the workability for maintenance of the fixing means 40 and improving the visibility and workability in the event of jamming of paper. In addition, at least one of the transfer belt unit 9, the image carrier units 67, and the developing means 20 can be released in a space above the first movable section 3 in the opened state for allowing the replacement of the image carriers 17 and the developing means 20, thereby improving the workability for replacing consumables.

Since there is no necessity of forming a large access opening for replacing consumables in the frame supporting the image forming means like a conventional apparatus, the rigidity of the frame is increased, thereby stably obtaining excellent images.

It can prevent an operator from touching the transfer belt when the second movable section 50 is opened and thus prevent the occurrence of image defect due to fingerprints putted by the touching. In addition, even if toner spills during the replacement, the toner can be received by the second movable section 50, thereby preventing t the resist rollers 37, the secondary transfer roller 39, the sheet feeding passage 38, and the fixing means 40 from being stained.

In addition, the secondary transfer roller 39 is evacuated from the transfer belt 14 when the first movable section 3 is opened, operation of removing a jammed paper sheet around the transfer belt 14 during printing of a plurality of paper sheets.

Figure 12:
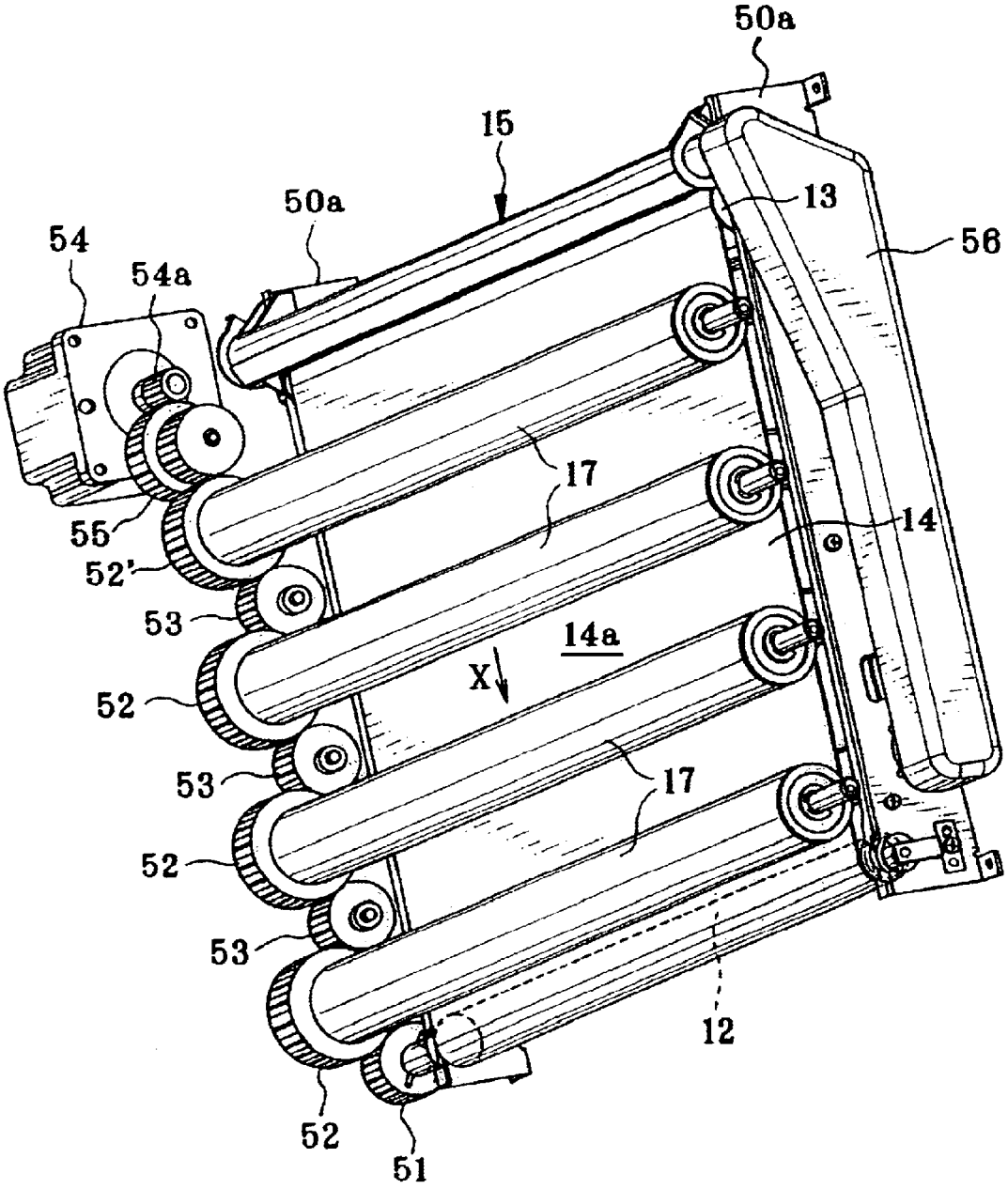
FIG. 12 is a perspective view showing the transfer belt and image carriers of the apparatus of FIG. 1.

FIG. 12 shows the intermediate transfer belt 14, the cleaning means 15, the primary transfer member 16, and the respective image carriers 17 of the image forming stations Y, M, C, K as described with reference to FIG. 1. The second movable section 50 (FIG. 8) comprises a pair of right and left side frames (side walls) 50*a*. The driving roller 12 and the driven roller 13 shown in FIG. 1 are attached to the frames 50*a*. The intermediate transfer belt 14 is laid around the driving roller 12 and the driven roller 13 with a constant tension. One end of the driving roller 12 is connected to a belt driving gear 51 and one end of each image carrier 17 is connected to image carrier driving gear 52, 52'. Idle gears are provided such that each idle gear is meshed with each pair of the adjacent driving gears 52, 52'. The driving motor 54 is located near the uppermost position of the belt face 14*a* of which traveling direction is downward. A transmission gear 55 which is a combination gear is meshed with a pinion gear 54*a* fixed to the rotational shaft of the driving motor 54 and meshed with the driving gear 52' of the uppermost image carrier 17. Numeral 56 designates a toner collecting container into which waste toner removed by the cleaning means 15 is collected.

In the above arrangement, the respective image carriers 17 are rotatably supported by a pair of frames (not shown) and are driven by the single driving motor 54 disposed near the upper portion of the intermediate transfer belt 14 because the rotation of the driving motor 54 are sequentially transmitted by the transmission gear 55, the image carrier driving gears 52, and the idle gears 53. The rotation is further transmitted from the lowermost image carrier driving gear 52 to the driving roller 12 of the intermediate transfer belt 14 via the belt driving gear 51 so as to drive the driving roller 12. The number of teeth of the idle gear 53 is set to be the same as the number of teeth of the belt driving gear 51 so as to synchronize their rotational periods to make one period of the driving roller 12 substantially equal to the interval of the primary transferring portion of each image forming means. Therefore, the rotational phases among the respective image carriers 17 and the gears can be set in the manufacturing process. Even after the image carriers 17 are replaced, there is a minimized possibility of occurrence of color registration error due to the periodic error among the respective image carriers 17.

In this case, the feeding speed of the transfer belt 14 is set to be faster than the peripheral velocity of the image carriers 17 by approximately 1–3%, thereby preventing the slack of the transfer belt 14 and thus achieving the stable driving of the transfer belt. It can also prevents the occurrence of color registration error so as to improve the image quality and can avoid the necessity of providing the cleaning means because the transfer efficiency is improved by setting a velocity differential.

The power train for the image carriers in FIG. 10 will be described with reference to FIGS. 13(A)–16(B). All of arrangements shown in FIGS. 13(A)–16(B) are of a type to be adapted to an image forming apparatus as shown in FIG. 10 in which the developing means 20 are supported by the housing body 2 and the image carrier units 67 and the transfer belt unit 9 are supported by the second movable section 50.

Figure 13A:
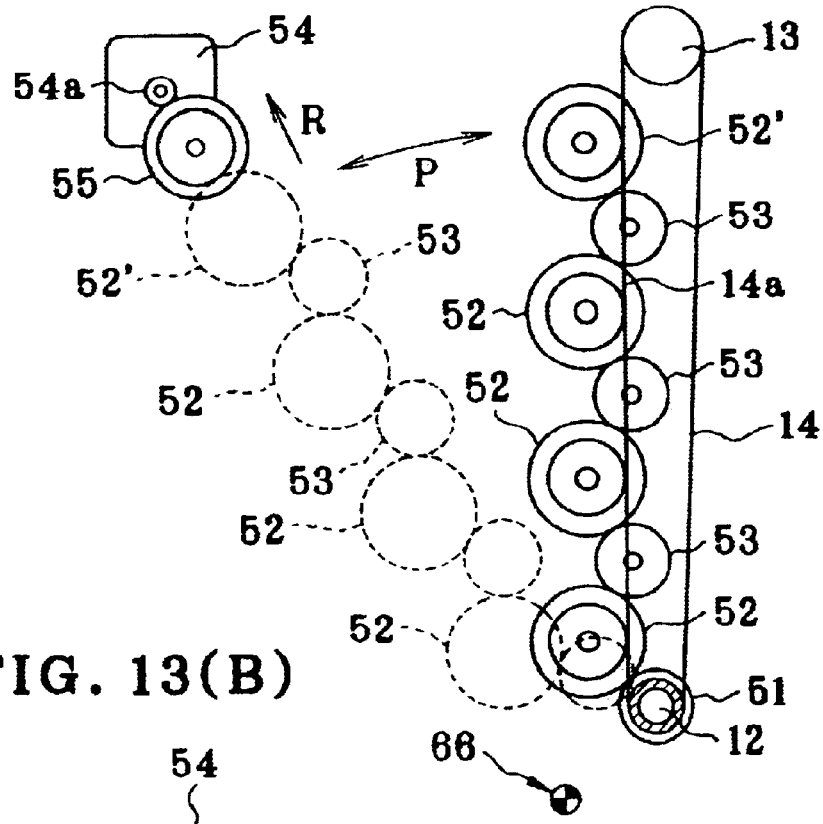
FIGS. 13(A), 13(B) are illustrations for explaining examples of a power train of the image carriers of FIG. 12.
Figure 13B:
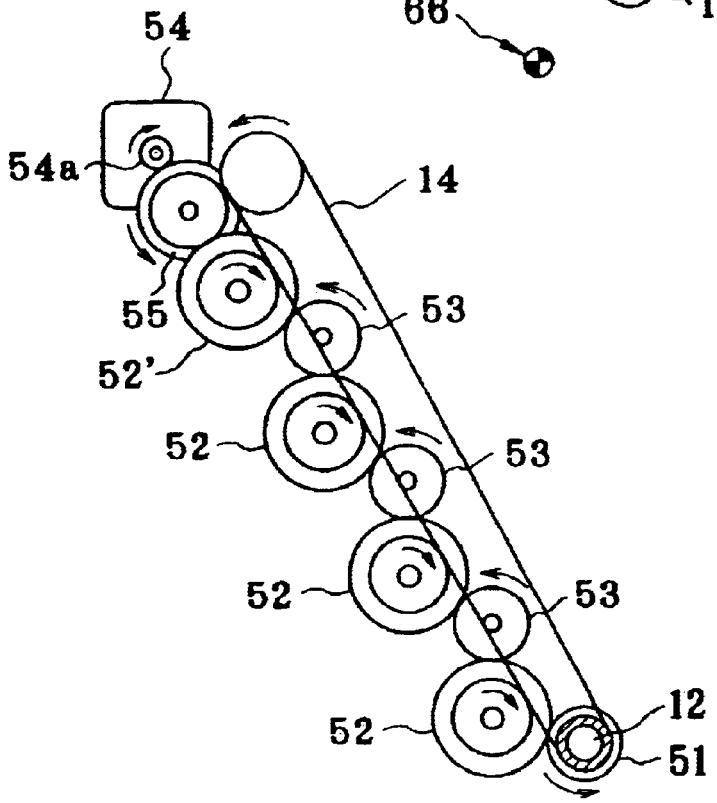

In FIGS. 13(A), 13(B), the driving motor 54 and the transmission gear 55 described with reference to FIG. 12 are attached to the housing body 2 and the belt driving gear 51, the image carrier driving gears 52', 52, and the idle gears 53 are attached to the image carrier units 67. The axes of transmission gear 55, the image carrier driving gears 52' 52, and the idle gears 53 are aligned in a row parallel to the belt face 14*a*, thereby achieving a simple power train with the minimum number of gears. The transfer belt unit 9 is pivotally moved about the shafts 66 in a direction of arrow P as shown in FIG. 13(A) and the image carrier driving gear 52' at the uppermost position of the belt face 14*a* of which traveling direction is downward is meshed with the transmission gear 55 as shown in FIG. 13(B). During this, all of the image carrier driving gears 52', 52 are rotated, whereby the image carrier driving gears 52', 52 are positioned and installed to the body and the image carrier driving gear 52' is meshed with the transmission gear 55 in the rotation normal direction R during installation.

In this arrangement, the transmission gear 55 and the image carrier driving gear 52' are meshed with slight rotation during installation, thereby achieving smooth meshing without damaging any of gears and preventing collision between tips not to fail to achieve the meshing. Replacement of the image carriers 17 may be frequently conducted. Even when there is an error in the rotational direction due to the replacement, the mash between the transmission gear 55 and the image carrier driving gear 52' never changes, thereby conducting stable power transmission.

Figure 14:
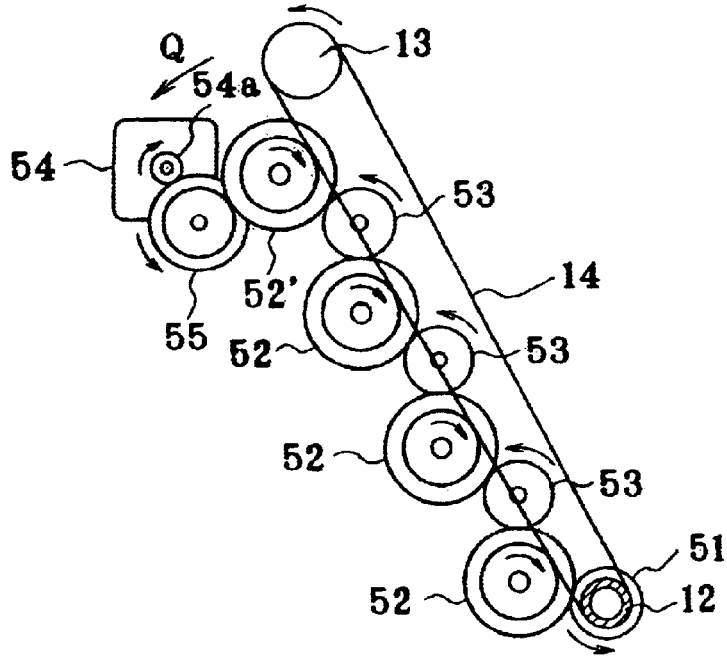
FIG. 14 is an illustration for explaining an example of a power train of the image carriers of FIG. 12.

In an example shown in FIG. 14, by rotating all of the image carrier driving gears 52', 52, the image carrier driving gears 52', 52 are positioned and installed to the body and the image carrier driving gear 52' is meshed with the transmission gear 55 in the rotation tangential direction Q during installation. According to this example, even when the positions of the transmission gear 55 and the image carrier driving gear 52' are changed relative to each other because the linear expansion coefficients of the body frame and the image carrier frames are different from each other, the meshing between the transmission gear 55 and the image carrier driving gear 52' is not affected, thereby providing stable transmission of driving force.

Figure 15:
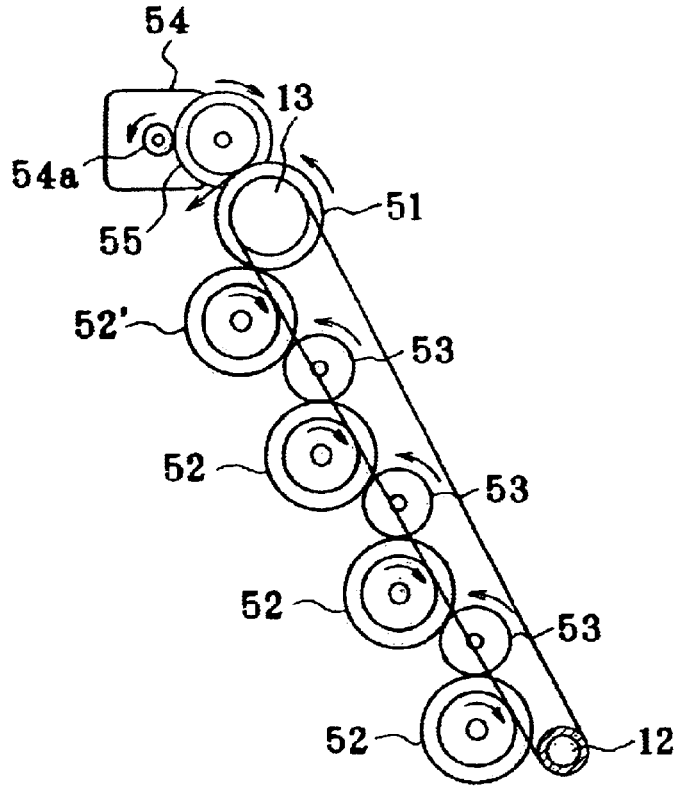
FIG. 15 is an illustration for explaining an example of a power train of the image carriers of FIG. 12.

In an example of FIG. 15, the driving roller 12 of the transfer belt 14 is located at the upper side, the driven roller 13 is located at the lower side, the transmission gear 55 is meshed with the belt driving gear 51, and the belt driving gear 51 is meshed with the image carrier driving gear 52'. According to this example, the driving force from the driving motor 54 is first transmitted to the belt driving gear 51, then transmitted to the uppermost image carrier driving gear 52', and after that, transmitted to the image carrier driving gears 52 in descending order.

According to this example, since the transfer belt 14 is driven at the upstream of the power train, the transfer belt 14 is hardly affected by variation in velocity of the power train as compared to the case that the transfer belt 14 is driven at the downstream, thereby preventing the velocity of the transfer belt 14 from varying and thus preventing the occurrence of color registration error and unevenness of image pitch (banding) which may be created at the primary transfer portion. The direction of the driving force from the transmission gear 55 is equal to the installing direction of the image carriers 17, thereby preventing the positions of the image carriers 17 from being changed due to the driving force.

In this case, the feeding speed of the transfer belt 14 is set to be slower than the peripheral velocity of the image carriers 17 by approximately 1–3%, thereby preventing the slack of the transfer belt 14 and thus achieving the stable driving of the transfer belt. It can also prevents the occurrence of color registration error so as to improve the image quality and can avoid the necessity of providing the cleaning means because the transfer efficiency is improved by setting a velocity differential.

Figure 16A:
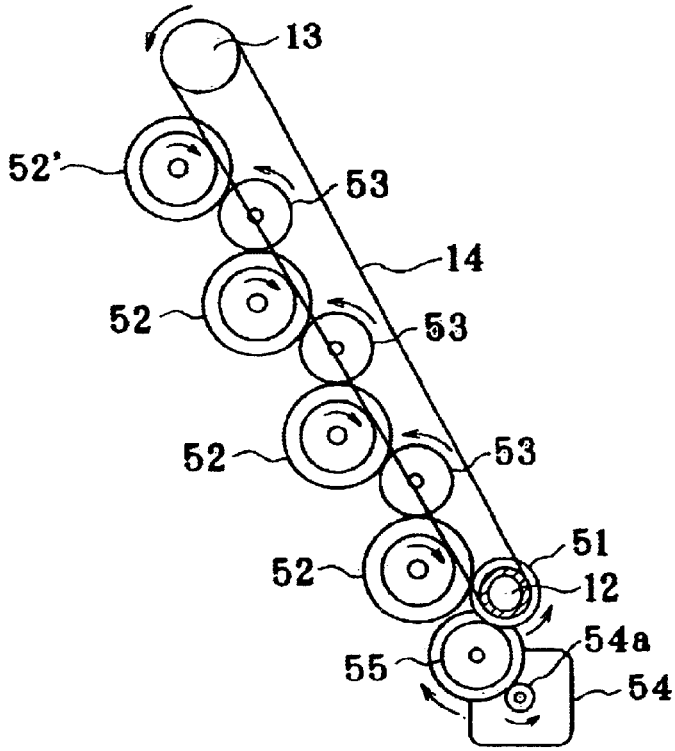
FIGS. 16(A), 16(B) are illustrations for explaining an example of a power train of the image carriers of FIG. 12.
Figure 16B:
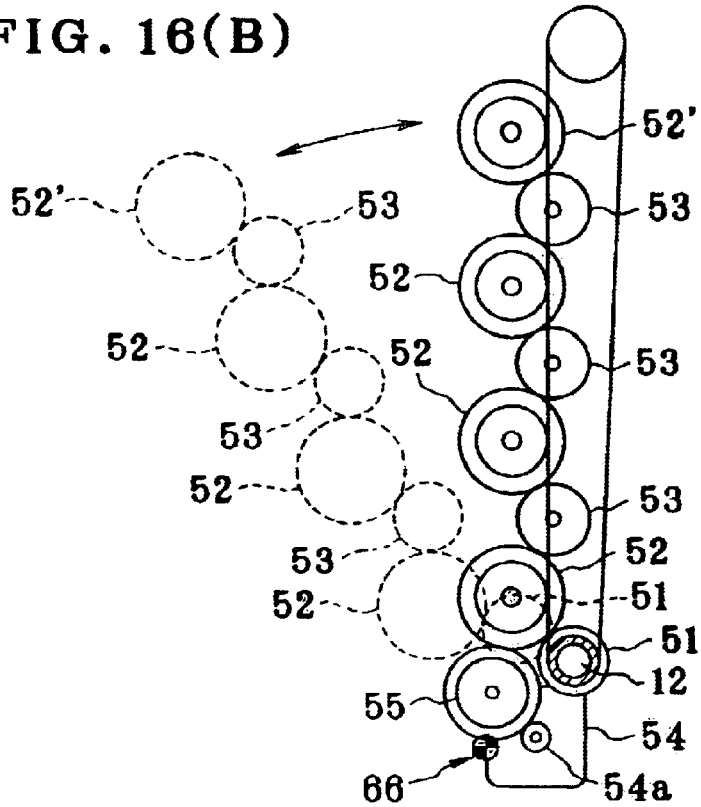

In an example of FIGS. 16(A), 16(B), the driving roller 12 of the transfer belt 14 and the driving motor 54 are located at the lower side and the driven roller 13 is located at the upper side, the transmission gear 55 is meshed with the belt driving gear 51, and the belt driving gear 51 is meshed with the image carrier driving gear 52. According to this example, the driving force from the driving motor 54 is first transmitted to the belt driving gear 51, then transmitted to the lowermost image carrier driving gear 52, and after that, transmitted to the image carrier driving gears 52 in ascending order.

According to this example, since the transfer belt 14 is driven at the upstream of the power train, the transfer belt 14 is hardly affected by variation in velocity of the power train as compared to the case that the transfer belt 14 is driven at the downstream, thereby preventing the velocity of the transfer belt 14 from varying and thus preventing the occurrence of color registration error and unevenness of image pitch (banding) which may be created at the primary transfer portion.

In this case, the feeding speed of the transfer belt 14 is set to be slower than the peripheral velocity of the image carriers 17 by approximately 1–3%, thereby preventing the slack of the transfer belt 14 and thus achieving the stable driving of the transfer belt. It can also prevents the occurrence of color registration error so as to improve the image quality and can avoid the necessity of providing the cleaning means because the transfer efficiency is improved by setting a velocity differential.

As shown in FIG. 16(B), the meshing point of the transmission gear 55 where it is meshed with the belt driving gear 51 which moves together with image carriers during installation is very close to the shafts 66 as the pivot of the pivotal movement for the installation of the image carriers. Therefore, even when there is an error in positioning the image carriers, the meshing point is little affected and the meshing between the transmission gear 55 and the belt driving gear 51 is not affected, thereby providing stable transmission of driving force.

As described above, in this embodiment, since the intermediate transfer belt 14 is disposed to be inclined relative to the driving roller 12, a large space is created on the right side of the intermediate transfer belt 14 in FIG. 1. The fixing means 40 can be disposed in the space, thereby achieving the reduction in size of the apparatus. This arrangement also prevent the heat generated by the fixing means 40 from being transferred to the exposure unit 6, the intermediate transfer belt 14, and the respective image forming stations Y, M, C, K which are located on the left side of the fixing means 40. Since the exposure unit 6 can be located in a space on the lower left side of the image forming unit 7, the vibration of the scanning optical system due to vibration of the driving system of the image forming means can be minimized and the deterioration of image quality can be prevented.

Further, in this embodiment, by employing spheroidized toner, the primary transfer efficiency is increased (approximately 100%). Therefore, no cleaning means for collecting residual toner after the primary transfer is used for the respective image carriers 17. Accordingly, the image carriers 17 of which diameter is 30 mm or less can be arranged closely to each other, thereby reducing the size of the apparatus.

Because no cleaning device is used, the corona charging means 19 is employed as a charging means. When the charging means is a roller, residual toner after the primary transfer on the image carrier 17 (the amount of which should be small) is deposited on the roller, leading to insufficient charging. However, since the corona charging means 19 is a non-contact charging means, toner hardly adheres to the image carriers, thereby preventing the occurrence of insufficient charging.

The actions of the image forming apparatus as a whole will be summarized as follows:

(1) As a printing command (image forming signal) is inputted into the control unit 4 of the image forming apparatus 1 from a host computer (personal computer) (not shown) or the like, the image carriers 17 and the respective rollers of the developing means 20 of the respective image forming stations Y, M, C, K, and the intermediate transfer belt 14 are driven to rotate.

(2) The outer surfaces of the image carriers 17 are uniformly charged by the charging means 19.

(3) In the respective image forming stations Y, M, C, K, the outer surfaces of the image carriers 17 are exposed to selective light corresponding to image information for respective colors by the exposure unit 6, thereby forming electrostatic latent images for the respective colors.

(4) The electrostatic latent images formed on the image carriers 17 are developed by the developing means 20 to form toner images.

(5) The primary transfer voltage of the polarity opposite to the polarity of the toner is applied to the primary transfer members 16 of the intermediate transfer belt 14, thereby transferring the toner images formed on the image carriers 17 onto the intermediate transfer belt 14 sequentially. According to the movement of the intermediate transfer belt 14, the toner images are superposed on the intermediate transfer belt 14.

(6) In synchronization with the movement of the intermediate transfer belt 14 on which primary images are transferred, a receiving medium P accommodated in the sheet cassette 35 is fed to the secondary transfer roller 39 through the pair of resist rollers 37.

(7) The primary-transferred image meets with the receiving medium at the secondary transfer portion. A bias of the polarity opposite to the polarity of the primary transfer image is applied by the secondary transfer roller 39 which is pressed against the driving roller 12 for the intermediate transfer belt 14 by a pressing mechanism (not shown), whereby the primary-transferred image is secondarily transferred to the receiving medium fed in the synchronization manner.

(8) Residual toner after the secondary transfer is carried toward the driven roller 13 and is scraped by the cleaning means 15 disposed opposite to the roller 13 so as to refresh the intermediate transfer belt 14 to allow the above cycle to be repeated.

(9) The receiving medium passes through the fixing means 40 whereby the toner image on the receiving medium is fixed. After that, the receiving medium is carried toward a predetermined position (toward the outfeed tray 3*a* in case of single-side printing, or toward the dual-side printing passage 42 in case of dual-side printing).

Figure 17:
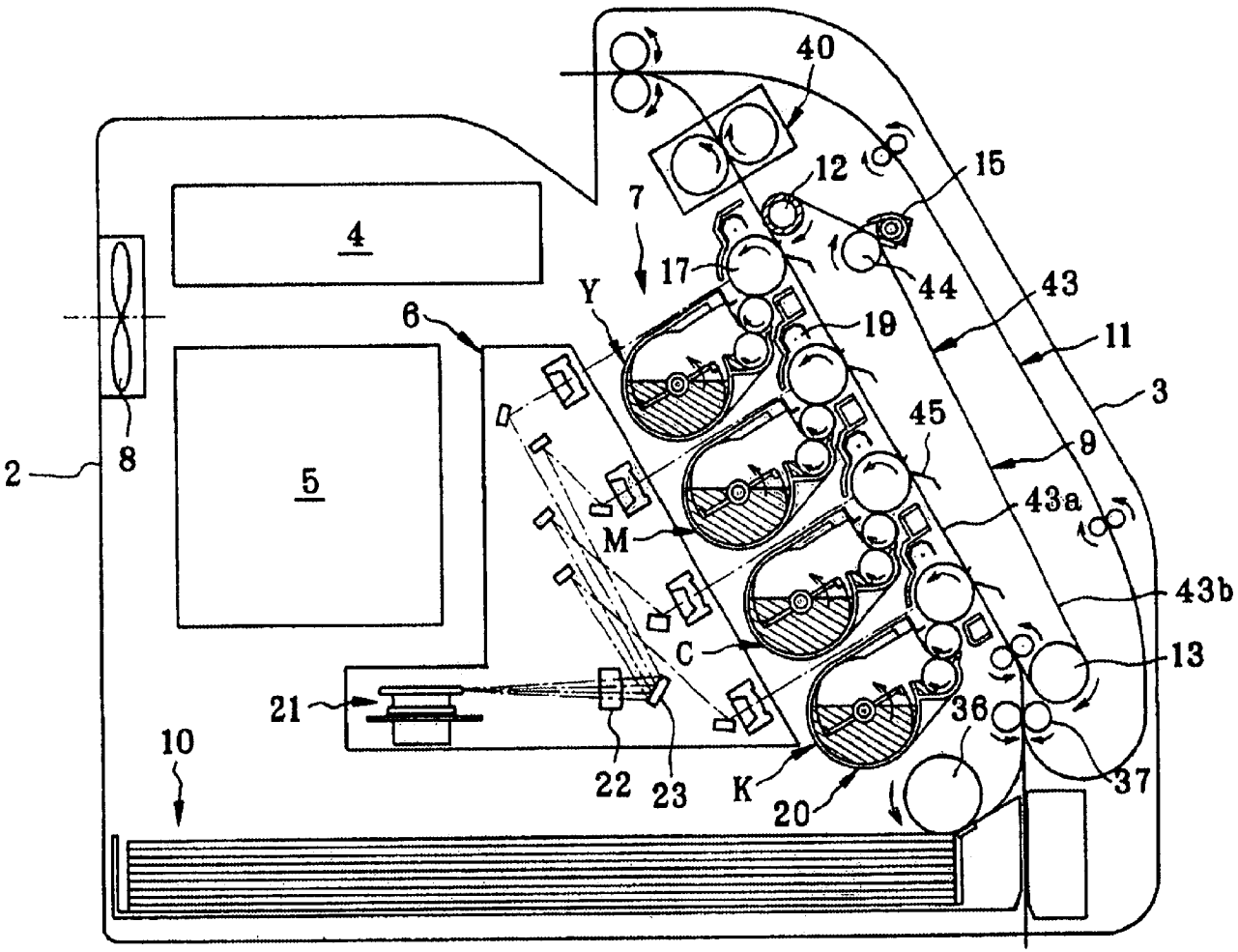
FIG. 17 is a schematic sectional view showing the entire structure of another embodiment of the image forming apparatus of the present invention.

FIG. 17 is a schematic sectional view showing the entire structure of another embodiment of the image forming apparatus of the present invention. The same components as those of the embodiment of FIG. 1 are marked with the same numerals, so description of such components will be omitted. This embodiment is of a type employing the paper delivery method as mentioned above. In this embodiment, therefore, a paper delivery belt 43 is employed instead of the intermediate transfer belt 14.

In this embodiment, a transfer unit 9 and a paper handling means 11 are arranged in a first moving section 3. The transfer unit 9 comprises a driving roller 12 which is disposed in an upper portion of a housing body 2 and is driven by a driving means (not shown) to rotate, a driven roller 13 and a backup roller 44 which are disposed diagonally below the driving roller 12, a paper delivery belt 43 which is laid around the three rollers with a constant tension and is driven to circulate in a direction indicated by an arrow (the clockwise direction), and a cleaning means 15 which abuts on the surface of the paper delivery belt 43 to oppose the back-up roller 44. The driving roller 12 and the paper delivery belt 43 are arranged obliquely to the upper left of the driving roller 13. Accordingly, a belt tension side (a side tensioned by the driving roller 12) 43 at the time of driving the paper delivery belt 43 is on the lower side and a belt slack side 43*b* is on the upper side.

On the back of the paper delivery belt 43, transfer members 45 composed of leaf spring electrodes are disposed. The transfer members 45 are pressed into contact with the back of the paper delivery belt 43 by their elastic force at locations corresponding to image carriers 17 of respective image forming stations Y, M, C, and K. A transfer bias is applied to each transfer member 45. The image carriers 17 of the image forming stations Y, M, C, K are in contact with the belt tension side 43*a* of the paper delivery belt 43. As a result of this, the image forming stations Y, M, C, K are arranged in an obliquely leftward direction relative to the driving roller 13 in FIG. 17.

Figure 18:
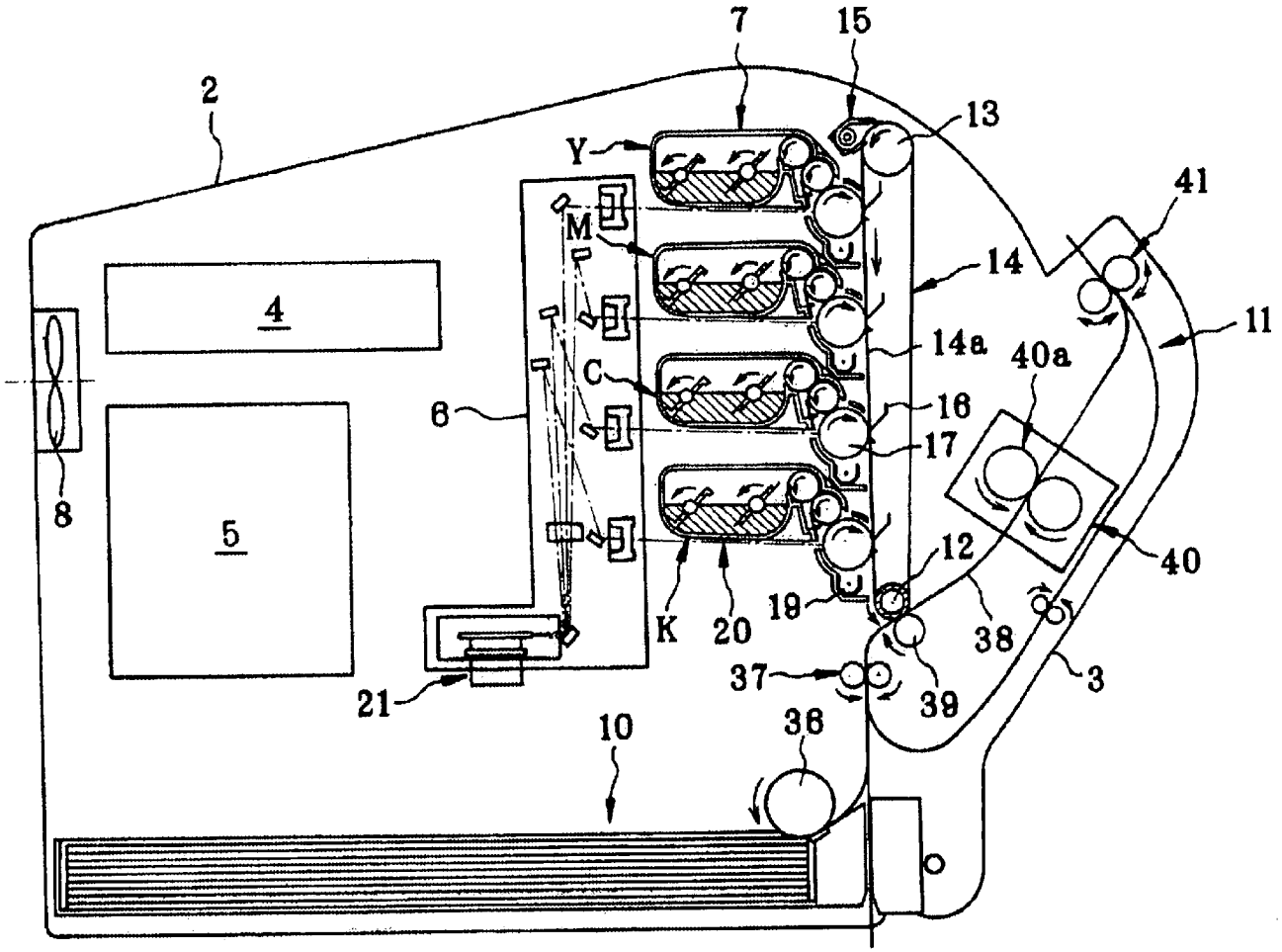
FIG. 18 is a schematic sectional view showing the entire structure of still another embodiment of the image forming apparatus of the present invention.

FIG. 18 is a schematic sectional view showing the entire structure of still another embodiment of the image forming apparatus of the present invention. The same components as those of the embodiment of FIG. 1 are marked with the same numerals, so description of such components will be omitted. This embodiment is an example in which the intermediate transfer belt 14 and the image forming stations Y, M, C, K are arranged in a vertical direction. The other structure, works and effects of this embodiment are the same as those of the embodiment shown in FIG. 1, so description will be omitted.

Though the present invention has been described with reference to the embodiments disclosed herein, the present invention is not limited thereto and the components of the present invention may be replaced with or include conventionally known or well known techniques.

For example, though the driving roller 12 is located at the lower side and the driven roller 13 is located at the upper side in both the embodiments of FIG. 1 and FIG. 18, the driven roller 13 may be located at the lower side and the driving roller 12 is located at the upper side.

In addition, though the pivots 57, 66 of the first movable section 3 and the second movable section 50 are located at the lower side of the housing body 2 so that they are movable vertically in the above embodiments, the pivots are located at a lateral side of the housing body 2 so that they are movable horizontally.

It should be noted that the intermediate transfer belt and the paper delivery belt are generally defined as a transfer belt.

What we claim is:

1. An image forming apparatus of a tandem type comprising image forming stations for respective colors arranged along a transfer belt, each image forming station including an image carrier, a charging means and a developing means disposed around said image carrier, wherein the transfer belt and the respective image forming stations are arranged at least one of obliquely and vertically, and the transfer belt is passed through the respective image forming stations, thereby forming a multi-color image, said image forming apparatus being characterized in that said transfer belt is laid around the driving roller and the driven roller with a constant tension, one of the driving roller and the driven roller is positioned obliquely above the other of the driving roller and the driven roller, the driving roller and the driven roller are disposed such that the belt tension side at the time of driving the transfer belt is on the lower side, and the image carriers of the respective image forming stations are in contact with the belt tension side.

2. An image forming apparatus as claimed in claim 1, being characterized in that said transfer belt is a paper delivery belt, and the driving roller is positioned obliquely above the driven roller.

3. An image forming apparatus as claimed in claim 1, being characterized in that said transfer belt is an intermediate transfer belt, and the driven roller is positioned obliquely above the driving roller.

4. An image forming apparatus as claimed in claim 3, being characterized by further comprising a secondary transfer roller to be pressed against the intermediate transfer belt to oppose said driving roller.

5. An image forming apparatus as claimed in claim 4, being characterized in that the diameter of said driving roller is smaller than the diameter of said driven roller.

6. An image forming apparatus as claimed in claim 3, being characterized by comprising a clearing means to be in contact with said belt tension side of the intermediate transfer belt at a position where is wrapped around the driven roller.

7. An image forming apparatus as claimed in claim 1, being characterized in that a fixing means is located obliquely above the belt slack side at the time of driving the transfer belt.

8. An image forming apparatus as claimed in claim 1, being characterized in that exposure means for forming latent images onto said image carriers is located below said respective image forming stations.

9. An image forming apparatus comprising image forming stations for respective colors arranged along a transfer belt, each image forming station including an image carrier, a charging means and a developing means disposed around said image carrier, wherein the transfer belt and the respective image forming stations are arranged obliquely or vertically, said image forming apparatus being characterized in that an exposure means for forming latent images onto said image carriers is located below said respective image forming stations, and wherein a control unit and a power source unit are located adjacent to each other above said exposure means and cooling air is introduced to spaces among the exposure means the control unit, and power source unit.

10. An image forming apparatus as claimed in claim 9, being characterized in that said transfer belt is an intermediate transfer belt.

11. An image forming apparatus as claimed in claim 9, wherein said transfer belt is a paper delivery belt.

12. An image forming apparatus as claimed in claim 9, being characterized in that a fixing means is located on the opposite side of said image forming stations relative to said transfer belt.

13. An image forming apparatus comprising image forming stations for respective colors arranged along a transfer belt, each image forming station including an image carrier, a charging means and a developing means disposed around said image carrier, wherein the transfer belt and the respective image forming stations are arranged obliquely or vertically, said image forming apparatus being characterized in that an exposure means for forming latent images onto said image carriers is located below said respective image forming stations, said exposure means having a casing and a single scanning means disposed at the bottom of said casing.

14. An image forming apparatus as claimed in claim 13, being characterized in that the single scanning means, an f-.theta. lens and a reflection mirror, and reflective mirrors, which bend scanning lines for respective colors reflected at the reflection mirror to aim the scanning lines to the image carriers, are disposed.

15. An image forming apparatus comprising image forming stations for respective colors arranged along a transfer belt, each image forming station including an image carrier, a charging means and a developing means disposed around said image carrier, wherein the transfer belt and the respective image forming stations are arranged obliquely or vertically, said image forming apparatus being characterized by further comprising: a housing body in which said respective image forming stations and the transfer belt are arranged; and a first movable section and a second movable section which are attached to said housing body such that the first and second movable sections are pivotally movable relative to said housing body, wherein a paper handling means and a fixing means are located in said first movable section and at least one of developing means, image carriers, and the transfer belt is located in said second movable section.

16. An image forming apparatus as claimed in claim 15, being characterized in that the pivots of said first movable section and said second movable section are located at a lower side of the housing body.

17. An image forming apparatus as claimed in claim 15, being characterized in that the pivots of said first movable section and said second movable section are located at a lateral side of the housing body.

18. An image forming apparatus as claimed in claim 15, being characterized in that said transfer belt is a paper delivery belt.

19. An image forming apparatus as claimed in claim 15, being characterized in that said transfer belt is an intermediate transfer belt.

20. An image forming apparatus as claimed in claim 19, being characterized in that said respective image forming stations are arranged obliquely and image carriers of said respective image forming stations are disposed in contact with a belt face, of which traveling direction is downward, of the intermediate transfer belt.

21. An image forming apparatus as claimed in claim 20, being characterized in that the driven roller for said intermediate transfer belt is located obliquely above the driving roller and that said driving roller and a second transfer roller compose a secondary transfer portion.

22. An image forming apparatus as claimed in claim 20, being characterized in that a fixing means is located obliquely above a belt face, of which traveling direction is upward, of said intermediate transfer belt.

23. An image forming apparatus as claimed in claim 20, being characterized in that a shifting means for moving the secondary transfer roller into contact with and apart from the intermediate transfer belt is located in said first movable section.

24. An image forming apparatus as claimed in claim 20, being characterized in that the pivots of said first movable section and said second movable section are located at a lower side of the housing body and the driven roller for said intermediate transfer belt is located obliquely above the driving roller, and being characterized by comprising: the image carriers for respective colors and the transfer belt which are attached to the second movable section; a belt driving gear for driving said driving roller; image carrier driving gears for driving the image carriers for the respective colors, one of which is meshed with said belt driving gear; idle gears each of which is meshed with each pair of the adjacent image carrier driving gears for the respective colors; a driving motor which is attached to the housing body and located near the uppermost position of the belt face of which traveling direction is downward; and a transmission gear which is meshed with the pinion gear of the driving motor and meshed with the uppermost image carrier driving gear.

25. An image forming apparatus as claimed in claim 24, being characterized in that the uppermost image carrier driving gear is meshed with said transmission gear in the rotation normal direction when said second movable section is pivotally moved to be installed.

26. An image forming apparatus as claimed in claim 24, being characterized in that the uppermost image carrier driving gear is meshed with said transmission gear in the rotation tangential direction when said second movable section is pivotally moved to be installed.

27. An image forming apparatus as claimed in claim 20, being characterized in that the pivots of said first movable section and said second movable section are located at a lower side of the housing body and the driving roller for said intermediate transfer belt is located obliquely above the driven roller, and being characterized by comprising: the image carriers for respective colors and the transfer belt which are attached to the second movable section; a belt driving gear for driving said driving roller; image carrier driving gears for driving the image carriers for the respective colors, one of which is meshed with said belt driving gear; idle gears each of which is meshed with each pair of the adjacent image carrier driving gears for the respective colors; a driving motor which is attached to the housing body and located near the uppermost position of the belt face of which traveling direction is downward; and a transmission gear which is meshed with the pinion gear of the driving motor and meshed with the belt driving gear.

28. An image forming apparatus as claimed in claim 20, being characterized in that the pivots of said first movable section and said second movable section are located at a lower side of the housing body and the driven roller for said intermediate transfer belt is located obliquely above the driving roller, and being characterized by comprising: the image carriers for respective colors and the transfer belt which are attached to the second movable section; a belt driving gear for driving said driving roller; image carrier driving gears for driving the image carriers for the respective colors, one of which is meshed with said belt driving gear; idle gears each of which is meshed with each pair of the adjacent image carrier driving gears for the respective colors; a driving motor which is attached to the housing body and located near the lowest position of the belt face of which traveling direction is downward; and a transmission gear which is meshed with the pinion gear of the driving motor and meshed with the belt driving gear.

29. An image forming apparatus comprising image forming stations for respective colors arranged along a transfer belt, each image forming station including an image carrier, a charging means and a developing means disposed around said image carrier, wherein the transfer belt and the respective image forming stations are arranged obliquely or vertically, said image forming apparatus being characterized by comprising a housing body in which said image forming stations and said transfer belt are arranged, and a movable section which is attached to said housing body such that the movable section is pivotally movable relative to said housing body, wherein a group of the transfer belt and the image carriers or a group of the transfer belt, the image carriers, and the developing means are arranged inside said movable section.

30. An image forming apparatus as claimed in claim 29, being characterized in that the pivot of said movable section is located at a lower side of said housing body.

31. An image forming apparatus as claimed in claim 29, being characterized in that the pivot of said movable section is located at a lateral side of said housing body.

32. An image forming apparatus as claimed in claim 29, being characterized in that said transfer belt is a paper delivery belt.

33. An image forming apparatus as claimed in claim 29, being characterized in that said transfer belt is an intermediate transfer belt.

34. An image forming apparatus as claimed in claim 33, being characterized in that the respective image forming stations are arranged obliquely, and the image carriers of the respective image forming stations are arranged in contact with the belt face, of which traveling direction is downward, of the intermediate transfer belt.

35. An image forming apparatus as claimed in claim 34, being characterized in that the pivot of said movable section is located at a lower side of the housing body and the driven roller for said intermediate transfer belt is located obliquely above the driving roller, and being characterized by comprising: the image carriers for respective colors and the transfer belt which are attached to the movable section; a belt driving gear for driving said driving roller; image carrier driving gears for driving the image carriers for the respective colors, one of which is meshed with said belt driving gear; idle gears each of which is meshed with each pair of the adjacent image carrier driving gears for the respective colors; a driving motor which is attached to the housing body and located near the uppermost position of the belt face of which traveling direction is downward; and a transmission gear which is meshed with the pinion gear of the driving motor and meshed with the uppermost image carrier driving gear.

36. An image forming apparatus as claimed in claim 35, being characterized in that the uppermost image carrier driving gear is meshed with said transmission gear in the rotation normal direction when said movable section is pivotally moved to be installed.

37. An image forming apparatus as claimed in claim 35, being characterized in that the uppermost image carrier driving gear is meshed with said transmission gear in the rotation tangential direction when said movable section is pivotally moved to be installed.

38. An image forming apparatus as claimed in claim 34, being characterized in that the pivot of said movable section is located at a lower side of the housing body and the driving roller for said intermediate transfer belt is located obliquely above the driven roller, and being characterized by comprising: the image carriers for respective colors and the transfer belt which are attached to the movable section; a belt driving gear for driving said driving roller; image carrier driving gears for driving the image carriers for the respective colors, one of which is meshed with said belt driving gear, idle gears each of which is meshed with each pair of the adjacent image carrier driving gears for the respective colors; a driving motor which is attached to the housing body and located near the uppermost position of the belt face of which traveling direction is downward; and a transmission gear which is meshed with the pinion gear of the driving motor and meshed with the belt driving gear.

39. An image forming apparatus as claimed in claim 34, being characterized in that the pivot of said movable section is located at a lower side of the housing body and the driven roller for said intermediate transfer belt is located obliquely above the driving roller, and being characterized by comprising: the image carriers for respective colors and the transfer belt which are attached to the movable section; a belt driving gear (or driving said driving roller; image carrier driving gears for driving the image carriers for the respective colors, one of which is meshed with said belt driving gear; idle gears each of which is meshed with each pair of the adjacent image carrier driving gears for the respective colors; a driving motor which is attached to the housing body and located near the lowermost position of the belt face of which traveling direction is downward; and a transmission gear which is meshed with the pinion gear of the driving motor and meshed with the belt driving gear.

* * * * *